US011633756B2

(12) United States Patent
Woolery et al.

(10) Patent No.: US 11,633,756 B2
(45) Date of Patent: Apr. 25, 2023

(54) REVERSIBLE NON-CONTACT ADHESIVE APPLICATOR DISPENSER

(71) Applicant: Valco Cincinnati, Inc., Cincinnati, OH (US)

(72) Inventors: Benjamin Woolery, Loveland, OH (US); Steven Turner, Franklin, OH (US)

(73) Assignee: VALCO CINCINNATI, INC., Cincinnati, OH (US)

( * ) Notice: Subject to any disclaimer, the term of this patent is extended or adjusted under 35 U.S.C. 154(b) by 197 days.

(21) Appl. No.: 17/237,242

(22) Filed: Apr. 22, 2021

(65) Prior Publication Data

US 2021/0245193 A1 Aug. 12, 2021

Related U.S. Application Data

(62) Division of application No. 15/321,779, filed as application No. PCT/US2015/036656 on Jun. 19, 2015, now Pat. No. 11,000,876.

(Continued)

(51) Int. Cl.
*B05C 5/02* (2006.01)
*B05B 15/68* (2018.01)

(Continued)

(52) U.S. Cl.
CPC ..... *B05C 5/0275* (2013.01); *B05B 15/50* (2018.02); *B05B 15/55* (2018.02); *B05B 15/68* (2018.02);

(Continued)

(58) Field of Classification Search
CPC ..... B05D 1/02; B05B 15/50; B05B 15/55; B05B 15/68
See application file for complete search history.

(56) References Cited

U.S. PATENT DOCUMENTS 4,262,582 A 4/1981 Sugimoto et al.
4,551,124 A 11/1985 Mowry (Continued)

FOREIGN PATENT DOCUMENTS

DE 9004733 U1 8/1990

OTHER PUBLICATIONS

International Search Report and Written Opinion dated Sep. 15, 2015 for PCT/US2015/036656 Filed Jun. 19, 2015. pp. 1-9.

(Continued)

*Primary Examiner* — Nathan T Leong
(74) *Attorney, Agent, or Firm* — Dinsmore & Shohl LLP

(57) ABSTRACT

A liquid dispenser. The dispenser includes reversible modular components to define selective removability and rearrangement between them and a base structure such that one or more sheets of a passing liquid-receiving substrate may receive such liquid through interchangeable liquid-dispensing orientations. The removability features include tool-free operation to facilitate quick insertion and removal of the modular components that include at least a liquid-dispensing valve assembly and a seal that is selectively engageable with the valve assembly to protect liquid-dispensing nozzles of the valve assembly from becoming clogged with residual dried liquid during periods of inactivity of the liquid dispenser. Selective movable cooperation or attachment between the modules—as well as between the modules and the base structure—facilitates flexible configurations of the dispenser, including top-down and bottom-up liquid-dispensing orientations.

17 Claims, 18 Drawing Sheets

Related U.S. Application Data

(60) Provisional application No. 62/016,163, filed on Jun. 24, 2014.

(51) Int. Cl.

| | |
|---|---|
| ***B05B 15/50*** | (2018.01) |
| ***B31B 50/62*** | (2017.01) |
| ***B05B 15/55*** | (2018.01) |
| ***B05D 1/02*** | (2006.01) |
| *B31B 100/00* | (2017.01) |

(52) U.S. Cl.

CPC ..... *B05C 5/02* (2013.01); *B05C 5/027* (2013.01); *B05D 1/02* (2013.01); *B31B 50/624* (2017.08); *B05C 5/0245* (2013.01); *B31B 2100/0022* (2017.08)

(56) References Cited

U.S. PATENT DOCUMENTS

| | | | | |
|---|---|---|---|---|
| 5,648,803 | A | 7/1997 | Koyama et al. | |
| 6,012,503 | A | 1/2000 | Balder | |
| 6,695,923 | B1 | 2/2004 | Shultz et al. | |
| 6,851,633 | B2 | 2/2005 | Stepaniak et al. | |
| 7,370,935 | B2 * | 5/2008 | Usuda | B41J 2/16532 347/29 |
| 7,601,218 | B2 | 10/2009 | Stepaniak et al. | |
| 8,753,713 | B2 | 6/2014 | Clark et al. | |
| 2000/4011978 | | 6/2004 | Minoru et al. | |
| 2004/0119780 | A1 * | 6/2004 | Usui | B41J 2/15 347/40 |
| 2006/0081727 | A1 | 4/2006 | Stepaniak et al. | |
| 2006/0158488 | A1 * | 7/2006 | Mori | B41J 2/17506 347/84 |
| 2010/0155435 | A1 * | 6/2010 | Yamazaki | B41J 2/16 29/592 |

OTHER PUBLICATIONS

International Preliminary Report on Patentability dated Feb. 17, 2016 for PCT/US2015/036656 Filed Jun. 19, 2015. pp. 1-18.

"Adhesive Application System Solutions for the Corrugated Board Industry" http://www.nordson.com Accessed/Published Date: 2017.

Extended European Search Report dated May 22, 2017 pertaining to European Application No. 15812111.1.

* cited by examiner

REVERSIBLE NON-CONTACT ADHESIVE APPLICATOR DISPENSER

This application is a divisional of U.S. application Ser. No. 15/321,779, filed Dec. 23, 2016, which is a US National Phase entry of International Application. No. PCI/US2015/036656, filed Jun. 19, 2015, which claims priority to U.S. Provisional Application 62/016,163 filed Jun. 24, 2014.

BACKGROUND OF THE INVENTION

This invention relates to a dispenser used in liquid deposition devices, and more particularly to a high speed, high precision dispenser with reversible liquid-dispensing components for use with adjacently-passing sheets of material such that an adhesive or other liquid can be deposited onto such sheets regardless of the feed direction of the sheets or orientation between the dispenser and the sheets.

Automated gluing systems are routinely used to affect high-speed, repeatable application of adhesives to various substrates. This practice has been used extensively in the manufacture of paper and related products, such as corrugated paperboard, where devices known as flexo folder gluers receive one or more sheets to have them printed, die cut, glued and folded. While in the gluing station portion of the flexo folder gluer, the sheet has one or more rows of continuous adhesive lines or discontinuous adhesive dots deposited onto one or more of its flap surfaces as it travels past a gluing device. In a conventional gluing station, the sheet is fed into a gap along a preferred path such that an aligned valve and nozzle can be actuated to deposit a stream of the adhesive onto the desired location on the sheet. The one or more valves are securely mounted to a support structure, such as a mounting plate, to ensure consistent adhesive application. While this works well for its intended purpose, it tends to be inflexible in terms of changing the valves out when service is required, or when different liquid-deposition orientations are required. For example, if a liquid dispenser is only configured to provide either top-down or bottom-up deposition onto the sheet, significant reconfiguring of the liquid-dispensing apparatus may be required, while in more inflexible arrangements, such manipulation may be altogether impossible. Such significant reconfiguring may include the use of tools to disassemble and reassemble parts of the apparatus, which is costly and time-consuming.

Moreover, during extended periods of gluing system inoperability where the valves are not dispensing adhesive, it is likely that any adhesive remnants still present on the valve nozzles will harden; in situations where such hardening blocks the adhesive flowpath, this will render the nozzles unsuitable for subsequent gluing system operation. Increased downtime to clean or otherwise care for the valves is one significant disadvantage of leaving the nozzles exposed during such periods. The difficulty associated with residual adhesive is particularly pronounced in non-contact-based adhesive dispensers where the fluid-dispensing nozzle is exposed to the atmosphere. Specifically, because the non-contact nozzle always has some remnants of adhesive on it even after shutoff, some of this adhesive will eventually dry on the tip after a pause in feeding sheets and cause a misglued or unglued sheet when the feed system is restarted. Misglued boxes can cause failures in automated packaging equipment and are not tolerated by end users.

Non-contact gluing systems offer significant advantages over glue heads that must touch the surface of the box or related substrate. When the glue applicator must touch the box surface, there is a significant risk of the box skewing due to the necessary tension in the process that is only applied to one side of the box. Contact gluing also requires careful guiding which adds further complexity and skew risk. Contact nozzles can also wipe residual adhesive onto places on the corrugated sheet where it is not desired, leading to boxes sticking together or sticking closed. Despite these limitations, contact-based systems offer the significant advantage of being able to be reversed such that they can apply glue in an upward direction to the bottom of a sheet on the same side of the machine to create a box where the glue tab is on the outside of the joint rather than the inside. Because the contact process makes it more difficult for the adhesive to fall back off the bottom surface, this technique works well. In order to avoid applying glue jets in a non-contact fashion in an upward direction, non-contact glue applicators are often used in pairs so that both sides of the sheet can have glue applied on the top surface on opposite sides of the box. This increases glue system cost and complexity.

As a result of the disadvantages of contact gluing and the complexity of non-contact gluing on two sides of the machine, it would be desirable to construct a non-contact adhesive applicator system that does not touch the sheet and can be reversed on the same side of the machine to glue upward on the bottom of the sheet. Further, it would be desirable for a non-contact applicator to be able to prevent residual glue from drying on the tips and affecting subsequent gluing events whether applying bottom-up or top-down.

The present inventors have determined that noncontact-based adhesive dispensing configurations would benefit from having modular features to allow easy and rapid gluing station reconfiguration. The present inventors have further determined that including a way to seal off adhesive flow-path components during extended periods of nonuse—where exposed adhesive may otherwise be prone to unintentional curing—would help promote superior adhesive deposition and gluing station operation.

SUMMARY OF THE INVENTION

According to one aspect of the present invention, an adhesive dispenser with a valve assembly may be used as an adhesive applicator where one or more valves that make up the assembly and their respective discharge nozzles can be quickly rearranged to accommodate changes in sheet-to-dispenser cooperation. In this way, if a need to switch between top-down and bottom-up fluid-dispensing operations arises, one or more of a valve assembly, sealing surface (also referred to herein as a sealing mechanism, or more simply as a seal) and one or more sheet guiding surfaces that are formed as modular units may be removed from, rearranged and attached to a supporting base structure without the need for tools or prolonged dispenser down-time.

Moreover, the valves and their respective nozzles are selectively coupled to the sealing surface as a way to prevent nozzle clogging that arises out of prolonged exposure to the ambient environment. In one preferred form, at least one of the sealing surface and the valves may be made movable relative to one another such that during periods where the valves are dispensing adhesive as part of the operation of the overall system, the sealing surface is removed from the valves to permit the free flow of adhesive, while during periods where the adhesive dispenser and the corresponding portions of the overall system are not operating, the relative movement between the sealing surface and valves is such that the nozzles are brought into contact with the sealing surface to close off ambient access to the nozzle tips and the adhesive remaining in the valve flowpath to prevent residual adhesive from collecting and hardening in or around the nozzle. In a more preferred form, the sealing surface is made of a compliant (for example, compressible) material to promote a more complete, secure cooperation between it and the nozzle. For example, the seals can be in the form of rubber, plastic or elastomeric material. In one embodiment, the seals can be brought into contact with their respective nozzles by generally horizontal sliding of one relative to the other, while in another embodiment, vertical movement of the nozzles can promote a secure pressing of the one to the other, while in yet another embodiment, a combination of horizontal and vertical movement may produce the desired seating of the nozzles to the seals. In another embodiment, seals can be rotated or pivoted to seat on the nozzles. The movement of the valves, seals or both may be promoted via air (or other pneumatic-based) actuators, spring-loaded actuators, electric-motor driven actuators or the like. Alternatively, the sealing surface could be a sealed bath of liquid or gel in which the nozzle tips sit to prevent them from drying out but when inverted, the liquid or gel would not leak out. In this case, the bath could be permanently mounted and the nozzle tips moved to the bath or movably mounted to meet the nozzle tips to seal them.

As mentioned above, a rapid, tool-free decoupling arrangement of at least one of the valves, seals and guides promotes rapid reconfiguration of the dispenser. In one form, the seals and valves may be coupled together and can be reversibly coupled to the base (or related support) structure. Likewise, the guides are coupled to the base structure in such a way that they may be removed and reversed. Within the present context, a reversibly coupled component (such as the seals, guides and valves) is one that is removable and reorientable such that it possesses a general symmetry about a travel path defined by the board, sheet or related substrate that receives an adhesive or related fluid thereon as a result of dispenser operation. Thus, in a configuration where the substrate travel path is defined along a generally horizontal right-to-left or left-to-right axis, a reversibly-coupled valve, seal or guide could be oriented to provide either top-down or bottom-up operation. The base structure (to which one or more of the above components may be reversibly connected) also exhibits reversible features. For example, in situations where the base structure is affixed to another structure (such as a housing, frame or the like) in such a way that it is not expected to be removed, pins (including spring-biased variants), apertures for receiving corresponding pins, or related securing features may be formed in the base structure (preferably to the surface that faces the substrate travel path) to permit the other components to be secured above or below the substrate travel path (in situations where such travel path is generally horizontal). Likewise, in situations where the base structure is itself removably affixed to a housing, frame or the like, comparable pins, apertures or related securing features (preferably to the surface that faces away from the substrate travel path) may be formed in the base structure to permit it to provide the necessary top-down or bottom-up placement of the adhesive or other fluid to the substrate that travels along such a generally horizontal path.

In another form of rapid, tool-free decoupling, the valve assembly is configured as a modular cartridge-based device, and can be coupled to an adhesive source and an actuation source to facilitate the selective delivery of the adhesive to the adjacently-passing sheet or related substrate. Sheets to be folded and glued (such as corrugated paperboard or any foldable substrate that is held together upon folding by an adhesive) are passed through the cooperating guides that are affixed to either the valve assembly or another portion of the dispenser to ensure proximity to the nozzles. In one form, one or more of the guides, valves and seals are coupled to a mounting surface on the base structure through suitable removable couplings that may be formed from spring-bias pins or other suitable quick-release mechanism to permit quick attachment, detachment and reorientation of the valve assemblies and guides. The spring-loading may be achieved by having each spring be coupled to posts that terminate with pull-up rings that are defined at the end of the posts; the posts include beveling, cutouts (for example, radial cutouts) or related shaping along their axial dimension such that upon being displaced along their axial dimension to overcome the spring bias, they can (possibly in conjunction with rotational movement about their longitudinal axis) permit the back plate and valve assembly to be moved relative to the base structure. Significantly, the actuation required to overcome the spring bias can be achieved through simple hand grasping and movement without the need for tools.

It will be appreciated by those skilled in the art that other liquids besides adhesives are capable of use with the adhesive dispenser, especially those where precise, repeatable application on a generally planar substrate is needed. As such, any such dispenser that includes nozzles that are at risk of clogging upon the drying out of the dispensed liquid during periods of non-use may be deemed to be within the scope of the present invention.

According to another aspect of the invention, an adhesive applicator includes a base structure, a modular valve assembly reversibly coupled to the base structure, a modular seal reversibly coupled to the base structure and movable relative to nozzles formed in the valve assembly to permit selective closure of the nozzles, and one or more substantially horizontal guiding surfaces. The guiding surface is cooperative with the valve assembly such that adhesive being dispensed from the nozzle is deposited onto at least a portion of the substrate that is introduced into a travel path that is defined by the guiding surface.

According to still another aspect of the invention, a method of depositing liquid on a sheet of material is disclosed. The method includes the steps of configuring the machine to include at least one cartridge movably coupled to a supporting structure. During periods of machine operation (i.e., when adhesive is being dispensed onto a substrate in the form of a board, sheet or related workpiece), nozzles and a seal are separated from one another to permit a relatively unimpeded direct flowpath of adhesive between the nozzles and the target substrate, while in periods of inoperability (i.e., when the machine is not being used for its intended adhesive-dispensing purpose), the nozzles and seals are moved into engagement with one another to retard or eliminate the buildup of residual adhesive on the nozzle. In one preferred form, the period of inoperability is sufficient that the adhesive would—if left in place—substantially dry or harden to the point where it would at least partially clog the flowpath defined by the nozzle. In another particular form, a coupling is biased to link the supporting structure and the nozzles to permit the tool-free attachment, detachment and reorientation of the nozzles. Additional steps include inserting the sheet of material into the travel path, and depositing adhesive or other liquid on at least a portion of the sheet of material. The cartridge is cooperative with a liquid source and an actuation source, the latter to effect the movement needed to selectively engage the nozzles and seals.

According to yet another aspect of the invention, a liquid dispenser with a modular, reorientable valve assembly and modular, reorientable sealing surface is disclosed. The modular nature of at least these components facilitates either top-down or bottom-up fluid-dispensing operations in a system, machine or related assembly that is configured to deposit the liquid onto a substrate. Significantly, the modular nature permits the removal, rearrangement and attachment of these components—either individually or cooperatively, depending on their attachment to one another—to a supporting base structure without the need for tools or prolonged dispenser down-time.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which:

FIGS. 9A and 9B show details relating to a top-down view of a selective engagement between the adhesive-dispensing nozzles and the sealing surface of the aspect of FIGS. 4A and 4B, while

and

Figure 14:
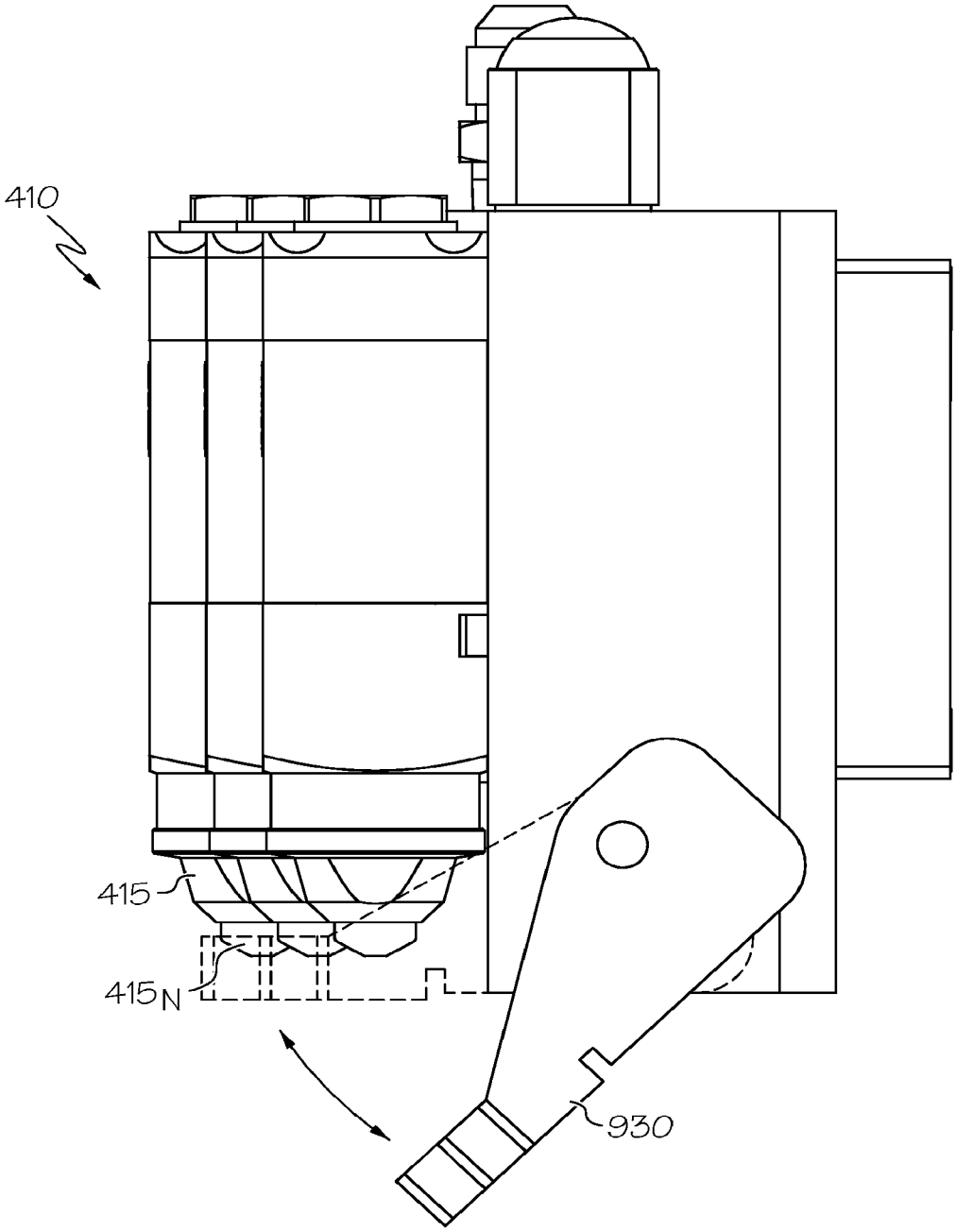

FIG. 14 shows an elevation view of a rotating sealing surface that selectively pivots against the nozzles to seal them according to another sealing embodiment of the present invention.

DETAILED DESCRIPTION

Figure 1:
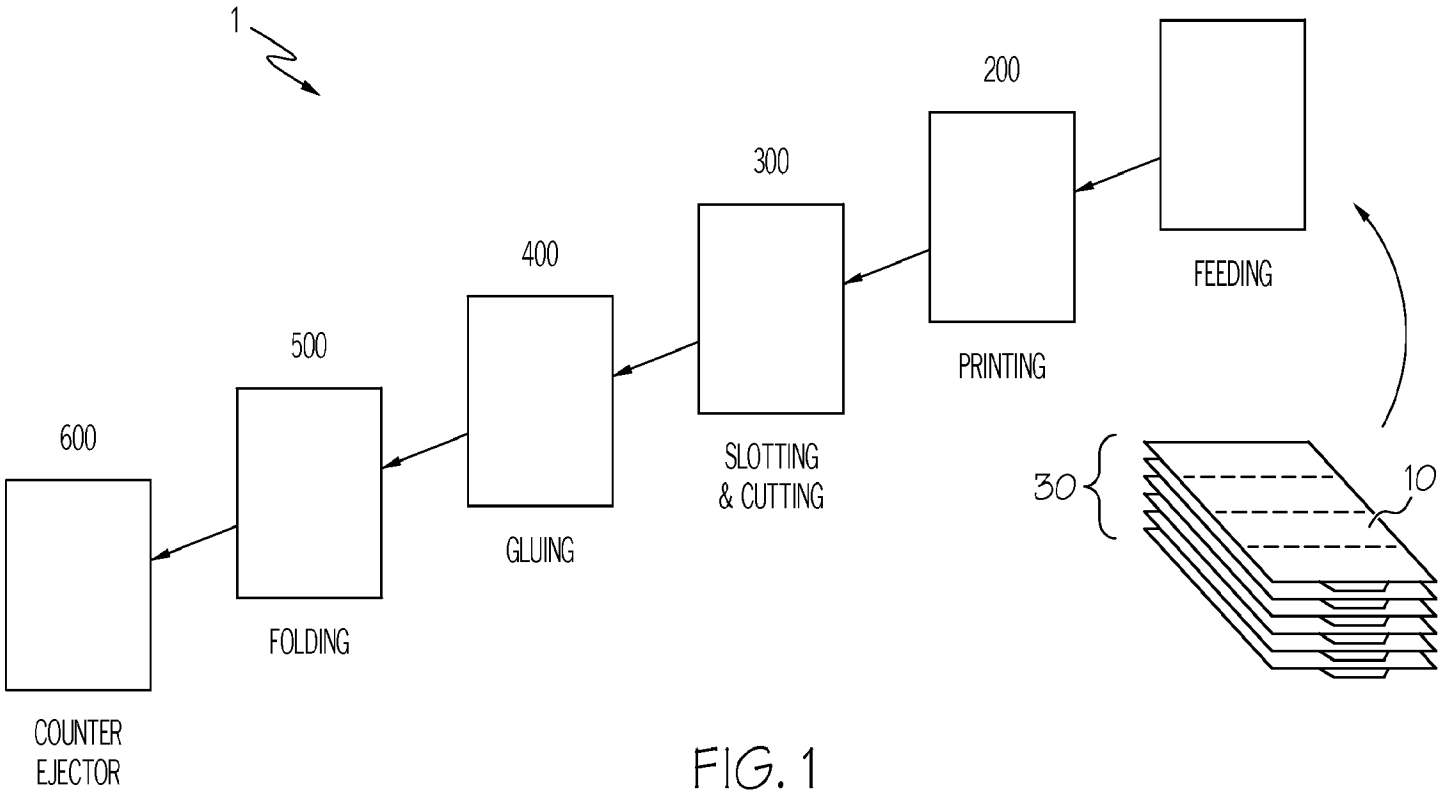
FIG. 1 shows a block diagram of the steps used in a flexo folder gluer for printing, cutting, gluing and folding corrugated board, including a gluing station according to the present invention and a stack of flat corrugated sheets prior to passage through the machine.
Figure 2:
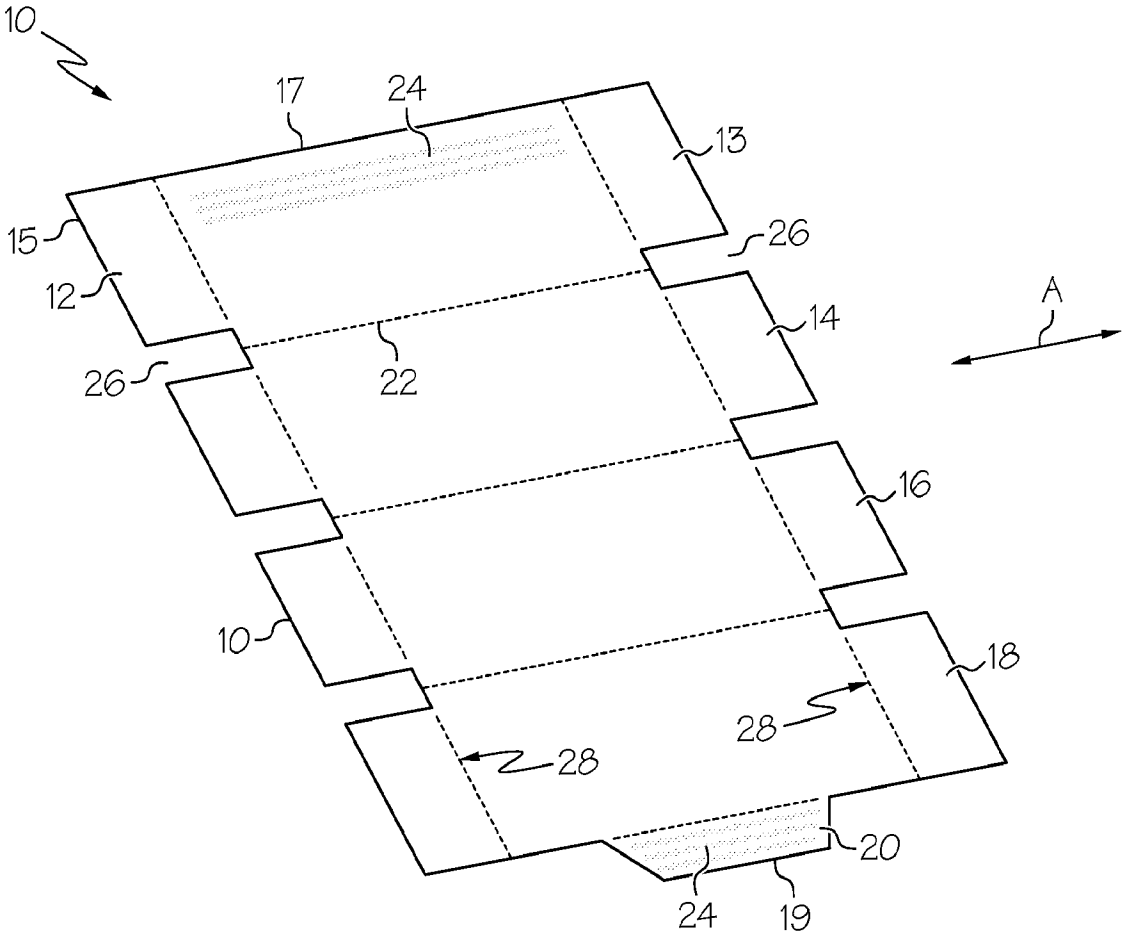
FIG. 2 shows a single sheet of the corrugated board of FIG. 1, highlighting the panel and tab locations where glue is often applied.

Referring initially to FIGS. 1 and 2, a block diagram highlights the steps associated with major components of a flexo folder gluer 1 according to the present invention, as well as a typical sheet 10 of corrugated paper on which the flexo folder gluer 1 operates. The flexo folder gluer 1 includes a feeding station 100, printing station 200, die cutting station 300, gluing station 400, folding station 500 and counter ejector station 600. It will be appreciated by those skilled in the art that additional components, such as controllers, conveyors (or similar sheet transport mechanism) and sensing and quality-control equipment, while not shown or discussed, are acknowledged to make up the remainder of the present flexo folder gluer 1. It will also be appreciated that certain operations may be consolidated, as, for example, gluing station 400 and folding station 500 can form a single station. Other stations, such as printing station 200, may be accomplished in a series of sub-stations (not shown). A quantity of sheets 10, shown in the figure as a stack 30, are introduced from the feeding station 100 to the print station 200 to receive printed indicia thereon by well-known printing methods. Sheet 10, which is typically corrugated board ranging from a single layer of approximately 2 millimeters (mm) thick up to a multilayer of approximately 15 mm thick, can include a series of panels 12, 14, 16 and 18 that are defined by creases or score lines 22, along which the various panels can be folded to form container structures of a desired dimension. The sheet 10 is typically fed into the flexo folder gluer 1 such that either of edges 15 or 13 can define the leading (or feed) edge, depending on which direction the sheet 10 is fed (as indicated by arrow A) into the feeding station 100. Lateral edge 17 generally coincides with a remote end panel (shown in the present figure as fourth panel 12), while lateral edge 19 generally coincides with a tab 20 used in subsequent folding operations. The gluing station 400 deposits adhesive (glue) along at least a portion of the length of one of the surfaces adjacent the edges 17, 19. As will be shown in more detail below, the gluing station 400 can be configured to deposit top-down, as shown by lines of adhesive (also referred to herein as glue pattern or the like) 24 in the figure, or bottom-up such that adhesive 24 is disposed on the opposing face from that shown. In addition, the flexo folder gluer 1 can be configured to have one gluing station 400 (which would enable the deposition of adhesive 24 on either top of or bottom of fourth panel 12 or top of or bottom of tab 20). Two such gluing stations (not shown) could be used to glue only top-down depending on whether the tab was to be placed on the outside of the fourth panel of the completed box or the inside and whether the box is folded upwards or downwards. It will be appreciated by those skilled in the art that while the adhesive 24 is shown as continuous lines along the travel path of the sheet 10, it could also be made up of discontinuous dots or beads (not shown). Sheet 10 can also include die cuts 26 that can be formed in the sheet 10 either prior to insertion of the sheet 10 into the flexo folder gluer 1, or by die cut station 300 that is part of the flexo folder gluer 1. Creases 28 (similar to creases 22) can be placed across the sheet feed direction A for additional folding options.

Figure 3A:
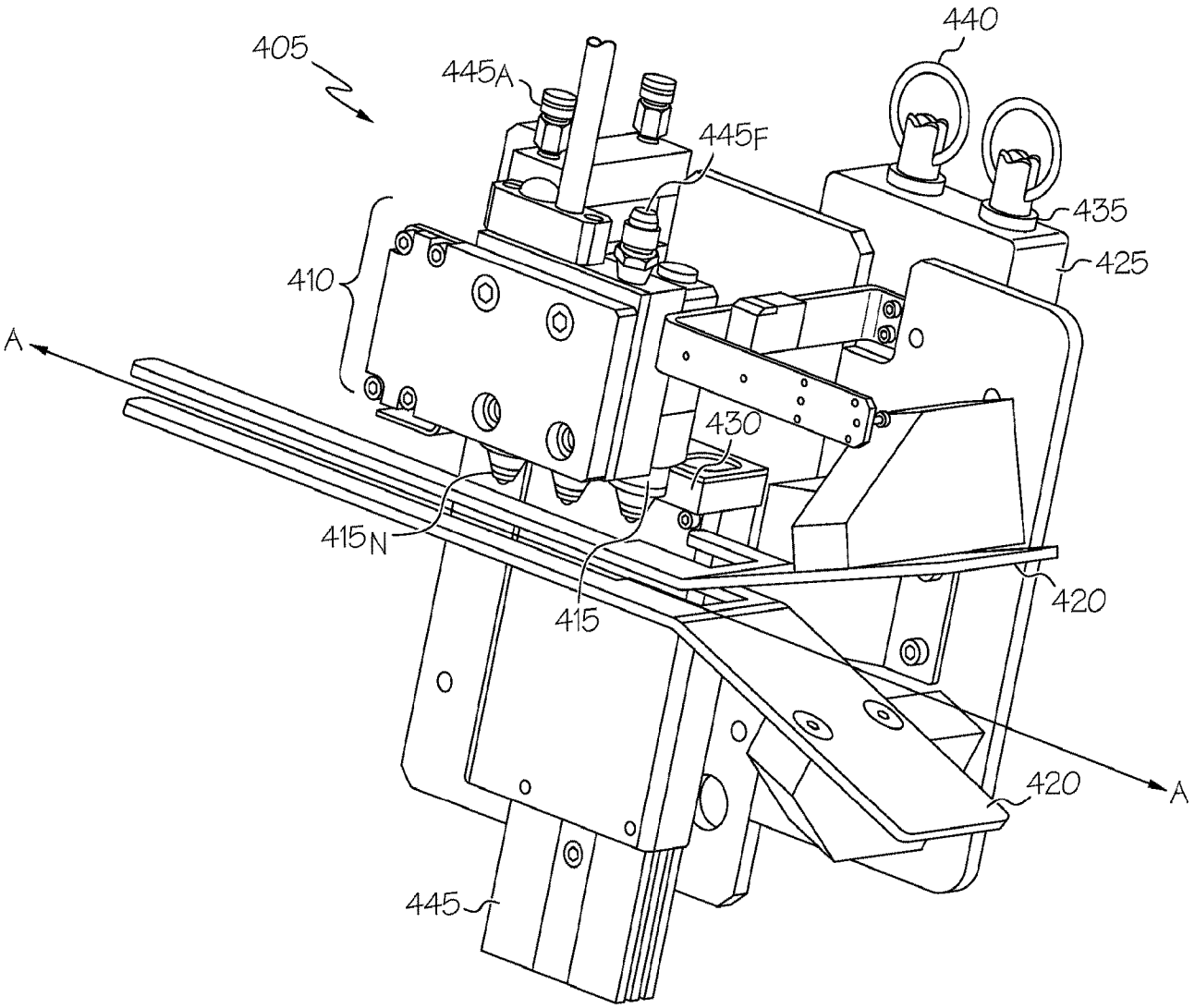
FIG. 3A shows a perspective view of a non-contact liquid dispenser in the form of an adhesive applicator with a top-down, right-side gluing and sheet feeding pattern according to an aspect of the present invention.
Figure 3B:
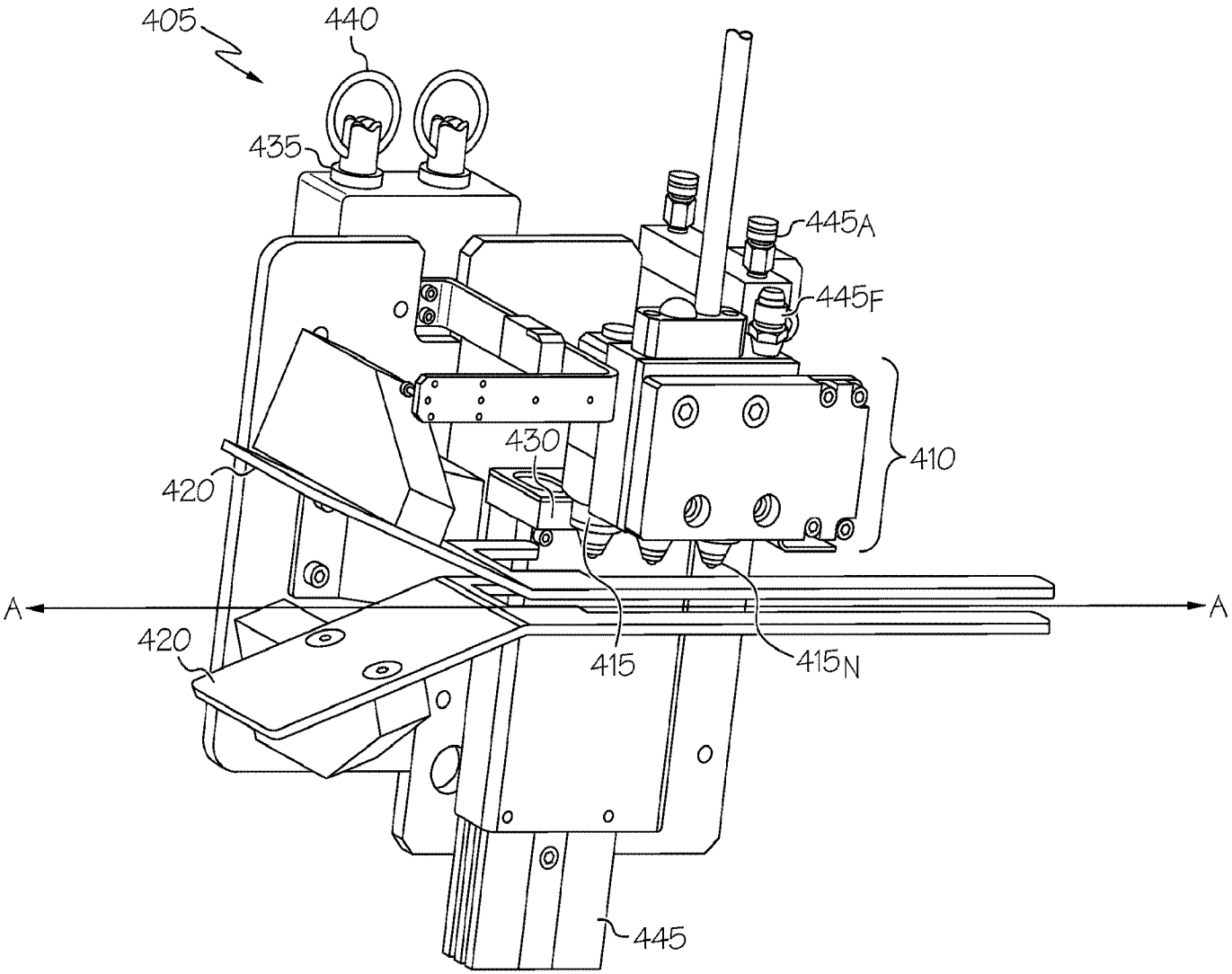
FIG. 3B shows a perspective view of the adhesive applicator of FIG. 3A where some of the removable components have been rearranged to perform top-down left-side gluing and sheet feeding.
Figure 4A:
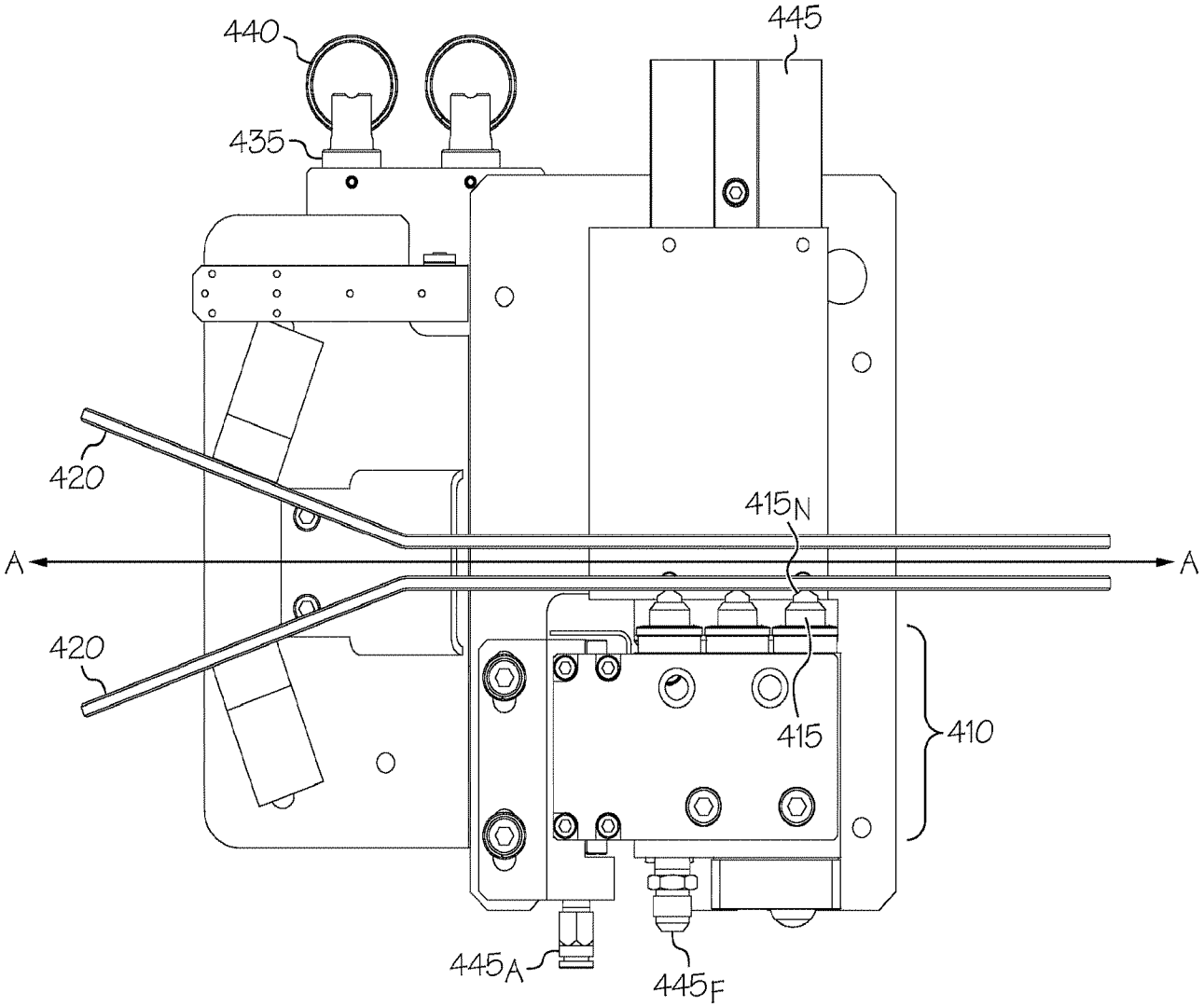
FIG. 4A shows an elevation view of the adhesive applicator of FIG. 3B after having been reconfigured to provide bottom-up gluing.
Figure 4B:
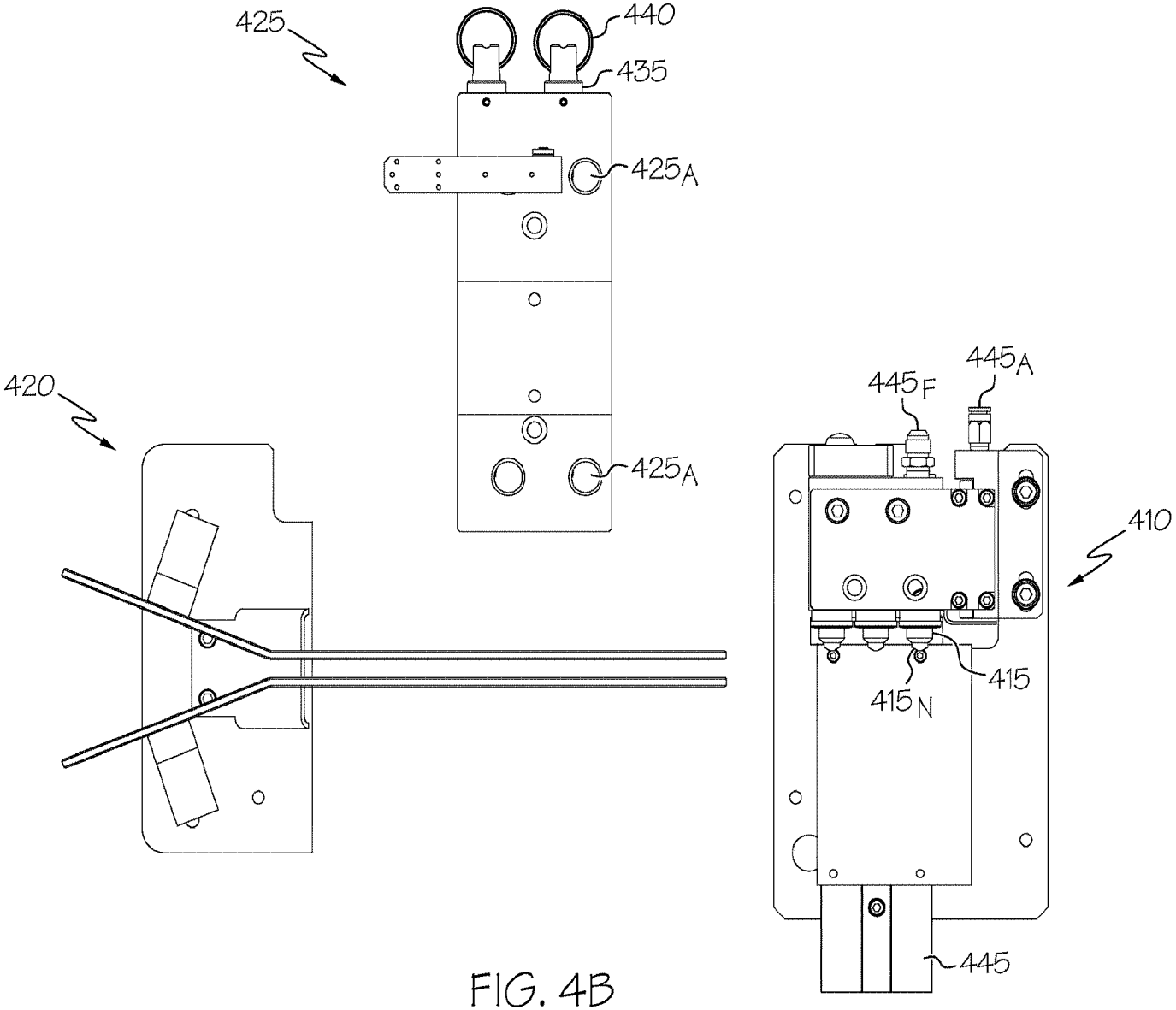
FIG. 4B shows an exploded view of the adhesive applicator of FIG. 4A.

Referring next to FIGS. 3A, 3B, 4A and 4B in conjunction with FIG. 2, details showing the reorientable features of a non-contact adhesive applicator 405 (alternately referred to as a dispenser) according to an aspect of the present invention are shown. In particular, FIG. 3A shows a top-down glue dispensing with right-side sheet feeding, FIG. 3B shows a top-down, left side glue dispensing, FIG. 4A shows a left-side, bottom-up glue dispensing and FIG. 4B shows three separate modular components of FIG. 4A that make up the applicator 405. The numerous modular components are capable of reversible mounting such that the applicator 405 can accommodate various liquid-dispensing orientations, sheet-feeding directions, nozzle-sealing operations or the like. One of the modular components is a valve assembly 410 with a series of valves 415 each of which terminates in a dispensing nozzle $\mathbf{415}_N$, while another is a pair of elongate guides (top and bottom) 420 to facilitate the placement of the moving sheets 10 into adhesive-dispensing cooperation with the dispensing nozzles $\mathbf{415}_N$. A base structure 425 is provided to allow the valve assembly 410 and guides 420 to be reversibly secured such that they can be switched out (either together or separately) in order to accept the various glue dispensing and sheet-feeding orientations. A sealing surface 430—which is also secured to the base structure 425—is made to selectively engage the nozzles $\mathbf{415}_N$ in order to protect them from becoming clogged due to the presence of dried residual adhesive. In one particular form, the sealing surface 430 is made up of pads that correspond to the number of valves and respective nozzles $\mathbf{415}_N$ (presently shown as three). The pads act as a flexible seat or nest for the nozzles $\mathbf{415}_N$ to keep any residual adhesive that may still be present on a surface thereof from drying out upon prolonged exposure to the air or related ambient environment. By relative mechanical movement between the valve assembly 410 and the sealing surface 430 (such as by pneumatic actuation of one or both), the nozzles $\mathbf{415}_N$ can be made to bury themselves into the pads of the sealing surface 430 during periods where adhesive dispensing has ceased. In addition to forming a substantially air-tight closure around the flowpath defined by the nozzles $\mathbf{415}_N$, the cooperative engagement between the nozzles $\mathbf{415}_N$ and sealing surfaces 430 can help push the adhesive and other debris away from the flowpath-defining nozzle orifice. In another form, the sealing surface 430 may be configured as a relatively rigid flat surface that also performs the nozzle $\mathbf{415}_N$ fluid isolation function.

In one form, the sealing surface 430 and valves 415 are coupled together to allow them to be reversibly coupled to the base structure 425 to facilitate easy removal, reorientation and attachment. Likewise, the guides 420 in this embodiment can either be part of the base structure 425 or coupled to it (by spring-biased pins 435, discussed in more detail below). In situations where reversibility is desired, it is important to have symmetry about the sheet feeding axis A-A of the station. In the present context, the base structure 425—while shown notionally as a modular unit in a manner generally similar to that of the modular valve assembly 410, guides 420 and sealing surface 430—may also be part of a larger structure, so long as it is capable of receiving one or more of these modular components in a removable, reversible way. Regardless of the connectivity to (or integration of) the base structure 425 to a larger load-bearing surface (such as to a frame or housing of station 400), either form of cooperation between them is deemed to be within the scope of the present invention as a way to embody such base structure 425. While the version depicted in the figure covers translational (or reciprocating) movement between the sealing surface 430 and nozzles $\mathbf{415}_N$ along the fluid-dispensing dimension, it will be appreciated by those skilled in the art that other forms of movement between them may also be employed, including pivoting (rotational) movement (shown in conjunction with FIGS. 14 and 18, as discussed below), sliding movement (shown in conjunction with FIGS. 9A through 9D and 13A through 13D, as discussed below) or the like; all such forms are deemed to be within the scope of the present invention. In a variation (not shown) on the embodiment depicted in FIGS. 4A and 4B, only one guiding surface need be utilized to protect the sheet from coming into contact with the liquid-dispensing nozzles. In such case, a guiding surface on the opposite side would be optional as a way to limit the distance between the sheet and the nozzles $\mathbf{415}_N$.

Figure 5:
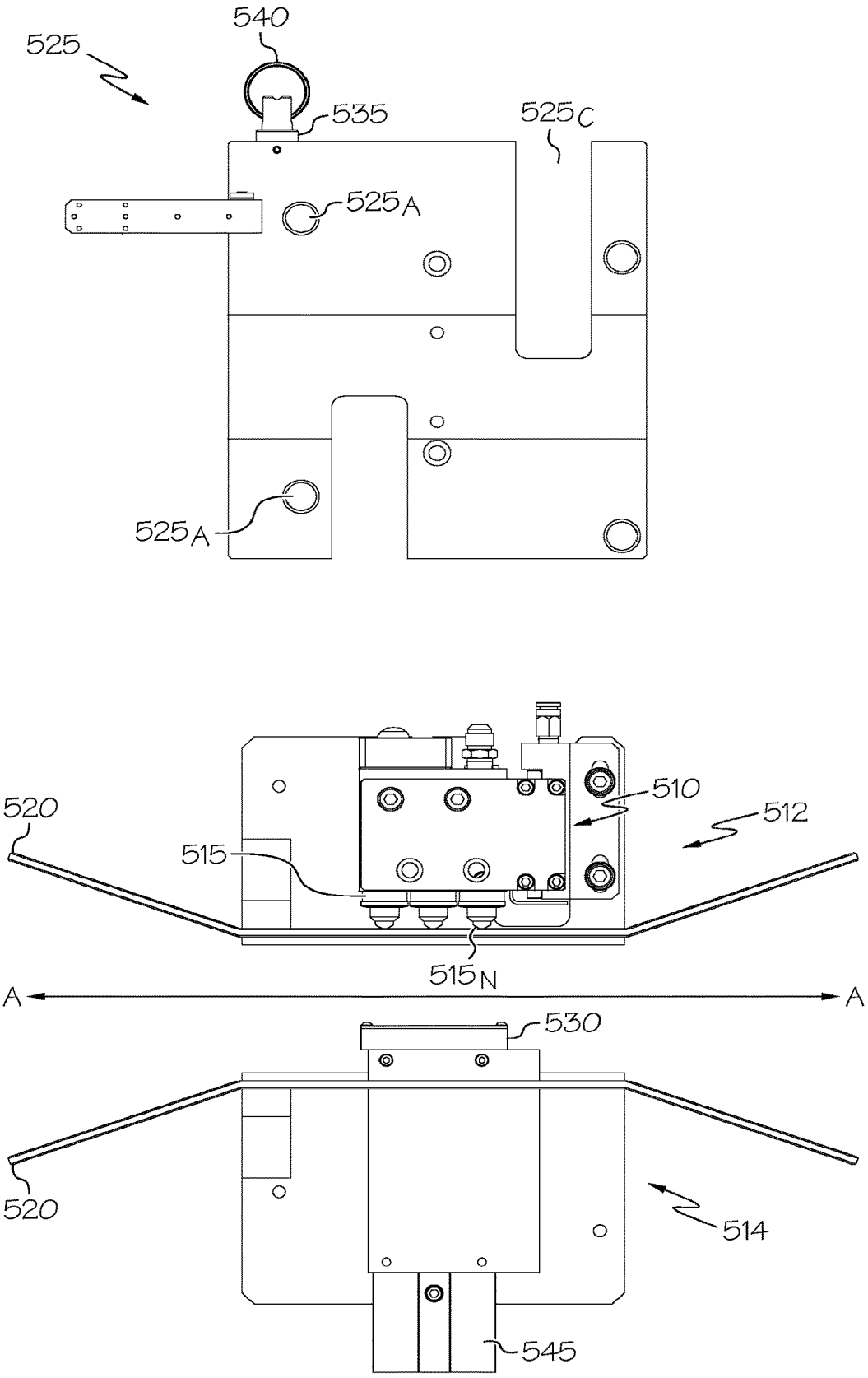
FIG. 5 shows an exploded view of the components of a top-down adhesive applicator according to another aspect of the present invention.

Referring next to FIG. 5, an exploded view of the top-down dispensing orientation and accompanying components of another aspect of the present invention are shown, where the valves 515 (as well as their corresponding nozzles $\mathbf{515}_N$) and sealing surface 530 are separate from one another and both reversibly coupled to a base structure 525, while the guides 520 could be fixed to the valves 515 and sealing surfaces 530 respectively or could both be fixed to one or the other of the valves 515 or sealing surface 530. In such a configuration, one of the guiding surfaces 520 of the pair is affixed along with a portion of the valve assembly 510 to define a first common module 512, while the other is affixed to the sealing surface 530 to define a second common module 514. The placement of the two common modules (also referred to herein as sub-modules) 512, 514 onto the base structure 525 is such that they are spaced sufficiently to define the sheet travel path along feeding axis A-A, where by the dual-ended beveling of the guides 520, either left-to-right or right-to-left directions of the guides 520 may be employed without having to flip the common modules 512, 514. As can be seen, the shape of the base structure 525 of the embodiment of FIG. 5 may differ from that of the base structure 425 of FIG. 4, including cutouts 525*c* that permit motion of the cylindrical valves 515 parallel to orifices 525A in order to move the valve assembly 510 into and out of the dispensing position from the sealing position. Although shown as having numerous apertures $\mathbf{525}_A$ capable of secured connection through a complementary pin (not shown) formed on the surface of the attachable common modules 512, 514 or related mountable components, it will be appreciated that the configuration may be reversed such that the base structure 525 could be outfitted with projecting pins (also called locating pins, as discussed elsewhere in this disclosure) that could engage complementary apertures formed in the mountable components; either variant is deemed to be within the scope of the present invention. In a manner similar to that of the embodiment of FIG. 4, spring-biased pins 535 (with their associated pull rings 540) and the associated structure (which is shown and described in more detail in FIGS. 10A through 10D) may be formed as part of base structure 525 in order to facilitate the tool-free reorientation of the common modules 512, 514.

Figure 6:
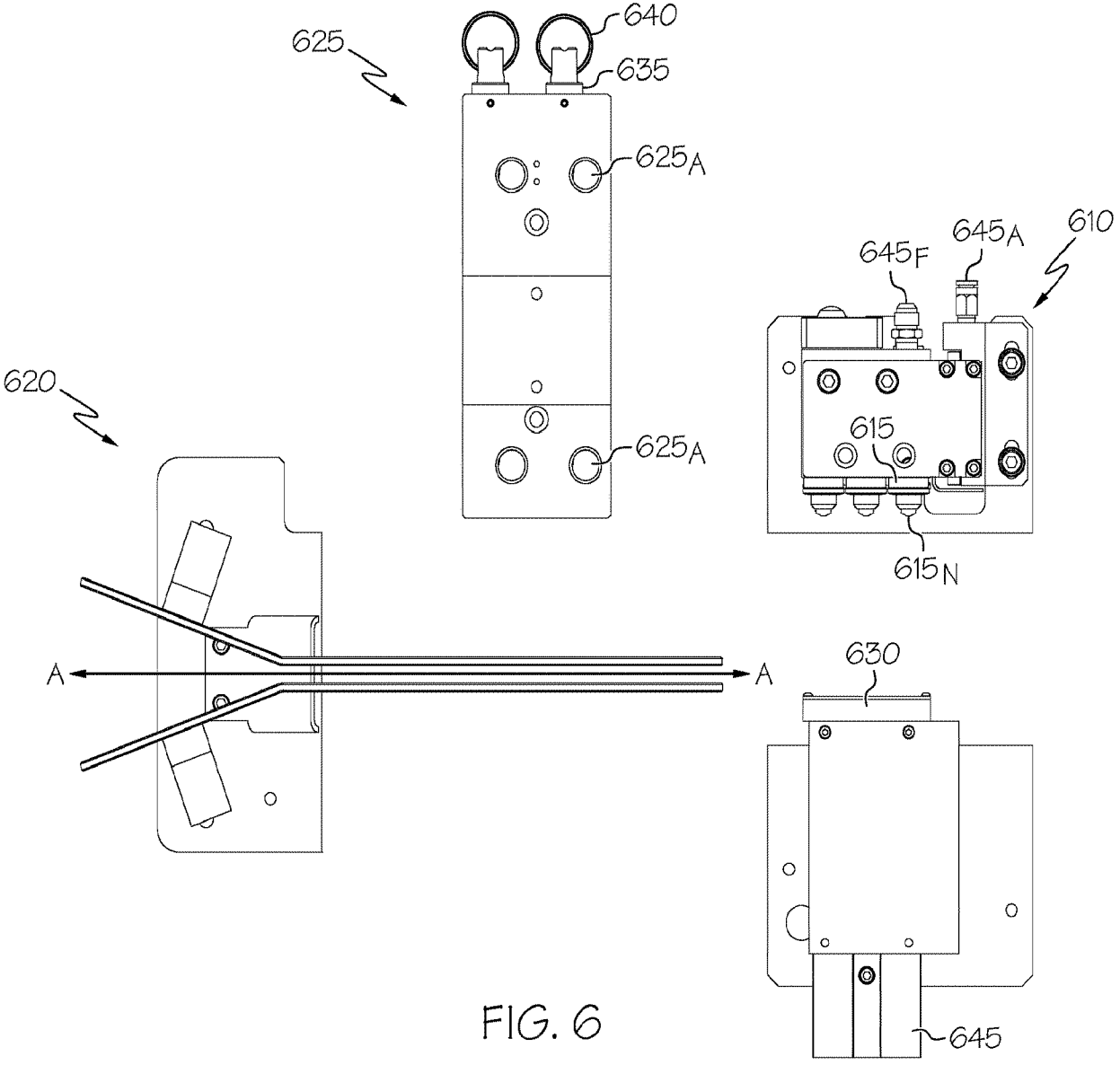
FIG. 6 shows an exploded view of the components of a top-down adhesive applicator according to yet another aspect of the present invention.

Referring next to FIG. 6, the top dispensing orientation and accompanying components of yet another aspect of the present invention is shown in which the guides 620 are separately fixed to the base structure 625 and the valves 615 and sealing surfaces 630 alone are reversibly coupled to the base structure 625. In such a configuration, the travel path of the sheets along the sheet feeding axis A-A would preferably be from left-to-right, although (as shown in the embodiment of FIG. 5), if a right-side set of beveled surfaces were formed on the guides 620, sheet-feeding from the opposite side (i.e., from right-to-left) could also be accommodated. As presently shown, each of the valve assembly 610 and sealing surface 630 are formed as separate modular units that can be releasably affixed to the base structure 625 through spring-biased pins 635 that are similar in construction to those of FIGS. 4 and 5. The guides 620 may be fixed to the valve assembly 610 and sealing surface modules 630 and reversed together with them respectively, or separately and reversibly fixed to the base structure 625, or simply fixed to the base structure 625 and symmetric across a sheet-feeding axis. As shown in the other embodiments, spaced-apart apertures formed into various locations along the vertically-oriented surface of the base structure 625 cooperate with outwardly-projecting locating pins (not presently shown) that are formed on adjacent surfaces of one or more of the valve assembly 610, sealing surface 630 and guiding surface 620 to permit the vertically reversible mounting of these modular components onto the base structure 625.

Figure 7:
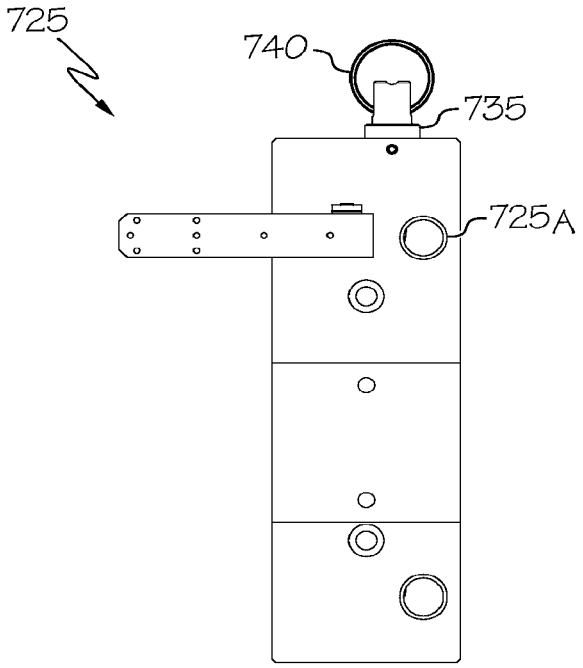
FIG. 7 shows an exploded view of the components of a top-down adhesive applicator according to still another aspect of the present invention.
Figure 7:
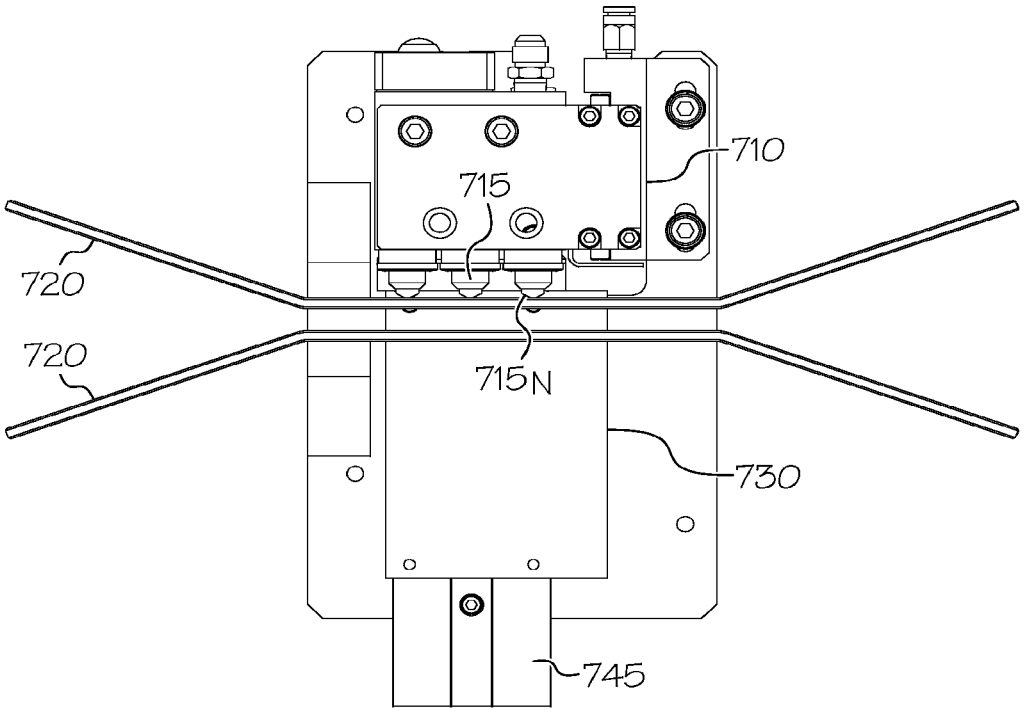

Referring next to FIG. 7, the top dispensing orientation and accompanying components of still another aspect of the present invention are shown, where the guides 720 themselves are geometrically reversible, and the whole assembly is turned upside down to move the sealing surface 730 and valves 715 together. A variation of this embodiment would use a horizontally-movable shutter-style (i.e., sliding) seal similar to that depicted in FIG. 13 in which the sealing surface 730 moves in the same plane as the sheet to slide over the nozzles 715 rather than in an orthogonal direction to meet the nozzles 715. Yet another sealing method would be a hinged flapper (also called a flip seal, similar to that depicted in FIG. 14) that closes over the nozzle $\mathbf{715}_N$ upon cessation of fluid-dispensing operations. Such a pivoting flap could operate on each individual nozzle $\mathbf{715}_N$ or all of them together.

In a variation (not shown) on the embodiment depicted in FIGS. 6 and 7 that is similar to that discussed above in conjunction with FIGS. 4A and 4B, only one guiding surface need be utilized to protect the sheet from coming into contact with the liquid-dispensing nozzles. In such case, the guiding surface on the opposite side would be optional. For example, a top-down adhesive deposition configuration could be used such that the valves, sealing surfaces and single guiding surfaces are reversible, while in another configuration, the entire dispenser is reversibly connected to the base structure and the single guiding surface reverses together with the dispenser. In either case, the single guiding surface is always located in the position to protect the sheet from contact with the nozzles whether they are dispensing from the top-down or bottom-up positions. In both examples, the guiding surface always remains on the same side of the dispenser as the nozzles in order to prevent the sheet from making contact with them.

Figures 8A, 8B, 8C, 8D:
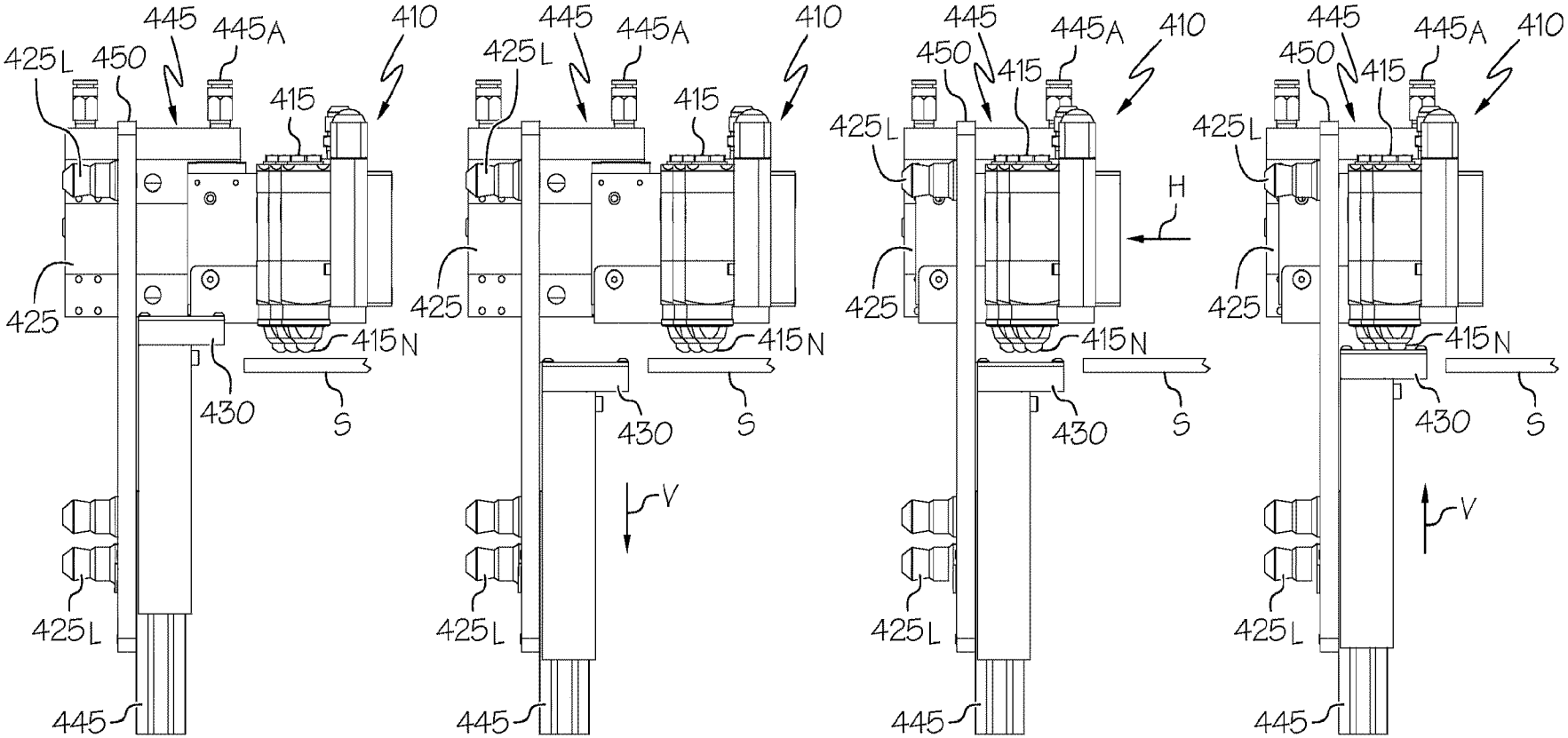
FIGS. 8A through 8D shows a notional transition sequence from top-down liquid dispensing to nozzle sealing according to the aspect of FIGS. 4A and 4B.

Referring next to FIGS. 8A through 8D in conjunction with FIGS. 4A and 4B, a sequence of movements in four separate time frames shows the transition from adhesive deposition onto a product sheet S (FIG. 8A) to sealing engagement between the sealing surface 430 and nozzles $\mathbf{415}_N$ when no adhesive is being deposited (FIG. 8D). When the modular valve assembly 410 is in the dispensing position, the sheet S is directly underneath the nozzles $\mathbf{415}_N$ while the sealing surface 430 is spaced horizontally away from the nozzles $\mathbf{415}_N$. When the valve assembly 410 needs to be in the parked (i.e., non-dispensing) position (for example, when the operation of gluing ceases), the sealing surface 430 moves first in a vertical direction V away from the nozzles $\mathbf{415}_N$, along actuator 445 (FIG. 8B) that may—in one form—be an air cylinder that is responsive to an pneumatic actuation source $\mathbf{445}_A$. After this, the valve assembly 410 with its valves 415 and nozzles $\mathbf{415}_N$ can slide in a horizontal direction H toward the sealing surface 430 (FIG. 8C), after which the sealing surface 430 moves back in a vertical direction to reestablish contact with the nozzles $\mathbf{415}_N$ (FIG. 8D). This process is reversed when the valve assembly 410 needs to be in the dispense position again. Locating pins $\mathbf{425}_L$ project from the back of mounting plate 450 to engage complementary-shaped apertures in base structure 425 (as shown in FIG. 3A). Although shown being used in exemplary fashion on the embodiment depicted in FIGS. 4A and 4B, the general translational movement between the sealing surface 430 and the valve assembly 410 (in general) and the valves 415 and nozzles $\mathbf{415}_N$ (in particular) may also be used in conjunction with the embodiments of FIGS. 5 through 7 such that all such variants are deemed to be within the scope of the present invention. Mounting plate 450 serves as the fixing point for the glue valves 415 and nozzles $\mathbf{415}_N$ as well as the air cylinders 445 that facilitate movement in the H and V directions of FIGS. 8B through 8D. For example, air cylinder 445 moves valve assembly 415 in and out across the glue station 400 to prepare for gluing or a parking position on the sealing surface. Air cylinder 445 moves the sealing surface against and away from the nozzles $\mathbf{415}_N$ in the V direction.

Figure 9A:
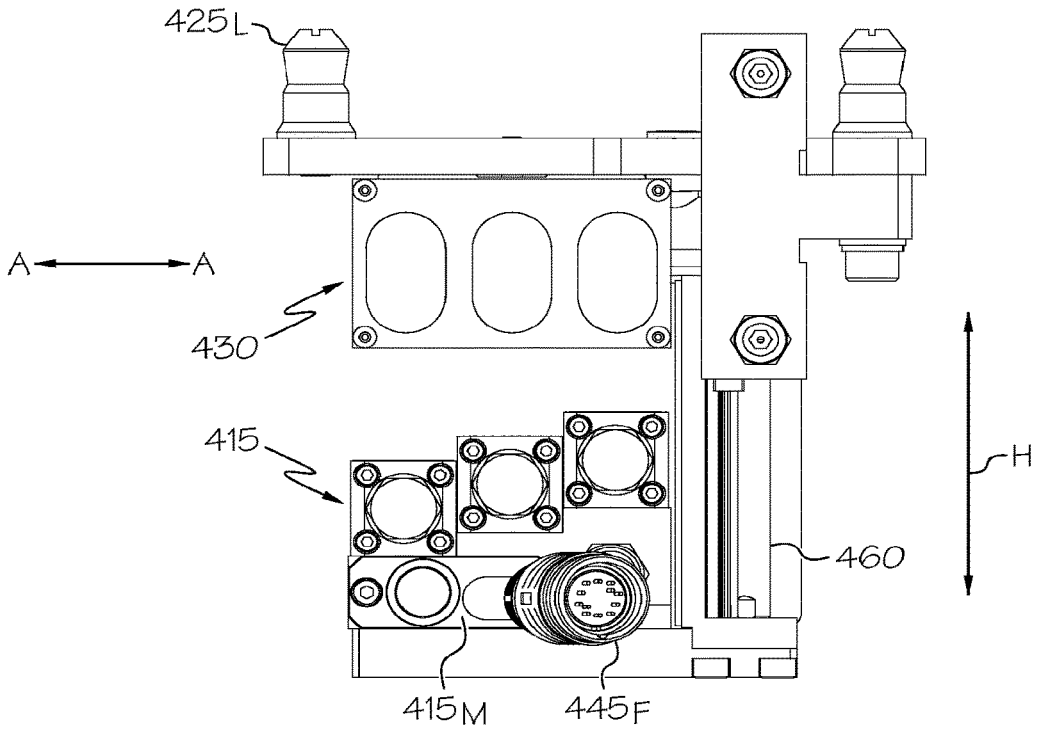
Figure 9B:
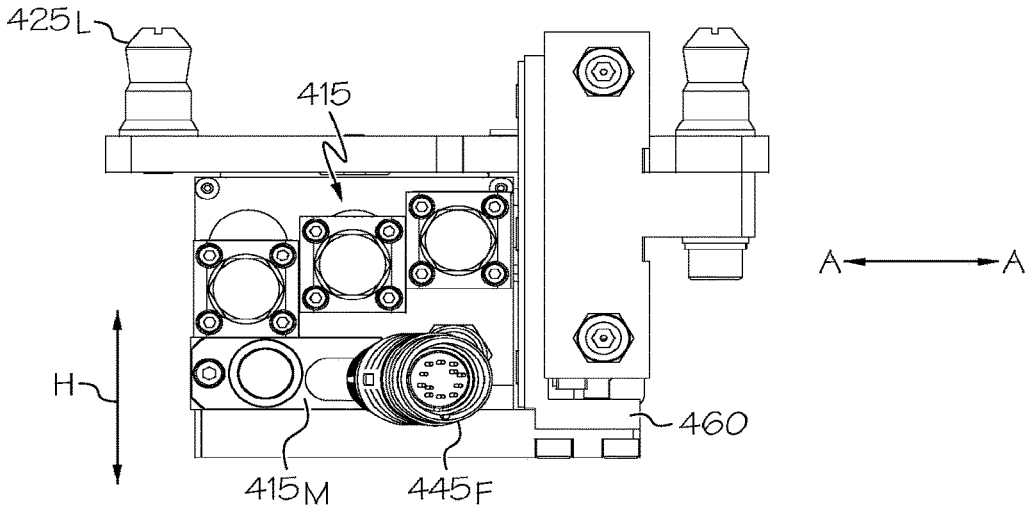
Figure 9C:
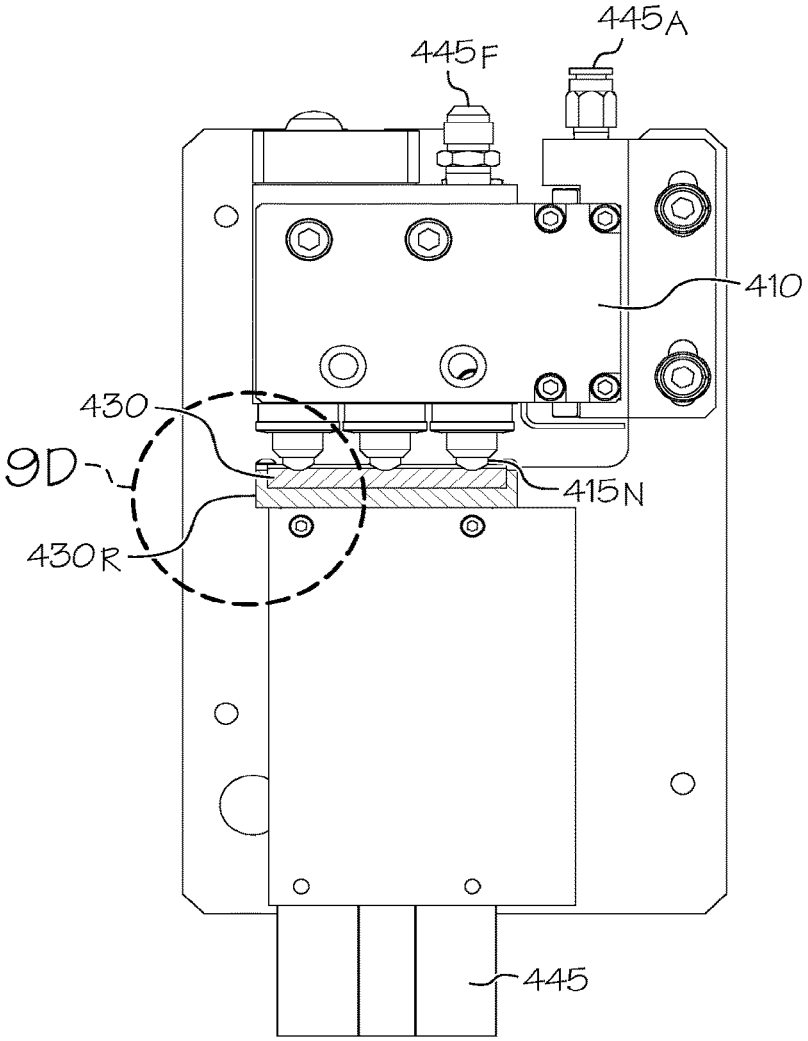
FIGS. 9C and 9D show an elevation view of the engagement of FIG. 9B with an emphasis on an additional retainer for the sealing surface.
Figure 9D:
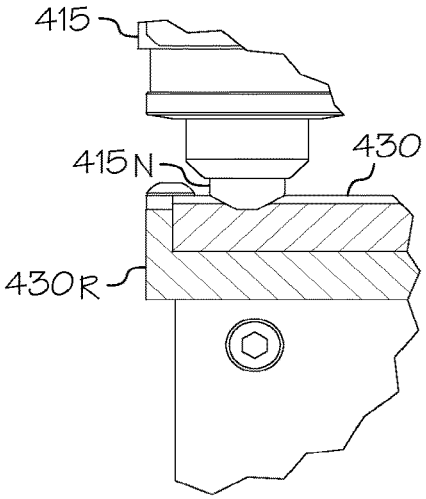

Referring next to FIGS. 9A through 9D in conjunction with FIGS. 3A, 3B, 4A and 4B, a top-down view (FIGS. 9A and 9B) and elevation view (FIGS. 9C and 9D) depicting the selective seating engagement of individual valves 415 with the sealing surface 430 are shown. The two top-down views of FIGS. 9A and 9B emphasize the two positions of the valve assembly 410 in the dispensing/operating position (FIG. 9A) and in the sealing position (FIG. 9B). As can be seen, the valves 415 may be linearly arranged across a dispensing surface; in one form, such linear arrangement may define a staggered or offset pattern as shown such that multiple closely-spaced (but not overlapping) parallel liquid patterns may be deposited onto the adjacently-passing sheet. In particular, the horizontal sliding movement H along a sliding member 460 between the valve assembly 410 and the sealing surface 430 that was discussed in conjunction with FIG. 8C is shown from a top-down view in FIGS. 9A and 9B. As shown with particularity in FIGS. 9C and 9D, the engagement between the elastomeric sealing surface 430 and the nozzle $\mathbf{415}_N$ of a single valve 415 is shown, as is the secure cooperation between the sealing surface 430 and a sealing surface retainer (also referred to herein as a sealing pad retainer) $\mathbf{430}_R$; as can be seen, the tip of the nozzle $\mathbf{415}_N$ is sufficiently isolated from the ambient environment such that any liquid (such as adhesive) that remains in or on the nozzle $\mathbf{415}_N$ is either incapable of curing or drying, or is pushed away from the liquid deposition flowpath. As shown with particularity in FIGS. 9C and 9D, sliding movement of the sealing surface 430 is limited to a generally linear travel path that is in the same general plane as—but orthogonal to—the travel path of the sheets or related substrate that are receiving the glue. The two elevation views of FIGS. 9C and 9D also depict the nozzles $\mathbf{415}_N$ embedding themselves slightly into the elastomeric seal; this act of embedding clears debris from around the nozzle tip and cuts off drying air from the exposed nozzle that would otherwise permit any locally remnant liquid adhesive to dry. In one preferred form, the sealing surface 430 is a sealing pad made of an elastomeric material (such as rubber, plastic or the like) that is approximately 2-4 millimeters thick. In addition, an actuator used to effect the sealing surface 430-to-valve assembly 410 movement is powered by pneumatic pressure, as shown by the air fitting $\mathbf{445}_A$. A comparable fluid fitting 445F is used for supplying adhesive to a manifold $\mathbf{415}_M$ which then distributes the adhesive to the individual glue valves 415. As discussed in the previous paragraph, although the sealing pad retainer $\mathbf{430}_R$ is shown being used in exemplary fashion on the embodiment depicted in FIGS. 4A and 4B, it may also be used in conjunction with the embodiments of FIGS. 5 through 7; as such, all of these variants are deemed to be within the scope of the present invention.

Referring next to FIGS. 10A through 10D in conjunction with FIGS. 4A and 4B, details associated with a locking mechanism that includes spring-loaded pins 435 that terminate in pull rings 440 to permit the selective release of one or more of the valve assembly 410 and guides 420 from the base structure 425 without the need for tools is shown. This ease of attachment and removal permits a quick way to reorient the fluid depositing apparatus depending on which of top-down, bottom-up, dispensing of adhesive is being performed. As shown with particularity in FIG. 10B, the pins 435 (via gripping at corresponding pull rings 440) are rotatable between locked and unlocked positions, where the latter permits disengagement between the pins 435 (which act as structural rods) and locating pins $\mathbf{425}_L$ as shown in FIGS. 8A through 8D. As shown with particularity in FIG. 10A, the pins 435 extend through a substantial entirety of the base structure 425 within an elongated channel $\mathbf{425}_C$ such that depending on the axial placement of the pin 435 within the channels $\mathbf{425}_C$, selective narrow and wide portions $\mathbf{435}_{WU}$ and $\mathbf{435}_N$ of the pins 435 may engage with the locating pins $\mathbf{425}_L$ that protrude outward from a frame in the form of the mounting plate 450 structure to which the base structure 425 is attached, as well s those locating pins $\mathbf{425}_L$ that protrude outward from the various components, modules or sub-modules disclosed herein. Apertures $\mathbf{425}_A$ formed through the base structure 425 are used to align the locating pins $\mathbf{425}_L$ so that the mounting plate 450 and base structure 425 become engaged. Faceted or beveled surfaces formed on one or both of the selective narrow and wide portions $\mathbf{435}_N$ and $\mathbf{435}_{WU}$ portions of the pin 435 may be used to provide a fit with the locating pins $\mathbf{425}_L$. Apertures $\mathbf{425}_A$ have two diameters, one to facilitate initial alignment of pin $\mathbf{425}_L$ and one for final alignment. Once pins 435 close against locating pins $\mathbf{425}_L$, the latter are drawn into aperture $\mathbf{425}_A$ due to the facet on locating pin $\mathbf{425}_L$. The pins 435 may be rotated about their elongate axis (such as by applying a torque to the pull rings 440) as a way to selectively engage these faceted or beveled surfaces. For example, by turning the rings 440 through a ninety degree rotation, the pins may be made to lock or unlock the two structures through the cooperating apertures $\mathbf{425}_A$ and locating pins $\mathbf{425}_L$, depending on whether a user is interested in keeping the various components in place or taken apart. Although described in conjunction with the embodiment of FIGS. 4A and 4B, the pins 435 and related structure are also applicable to the other embodiments disclosed herein.

Figure 10A:
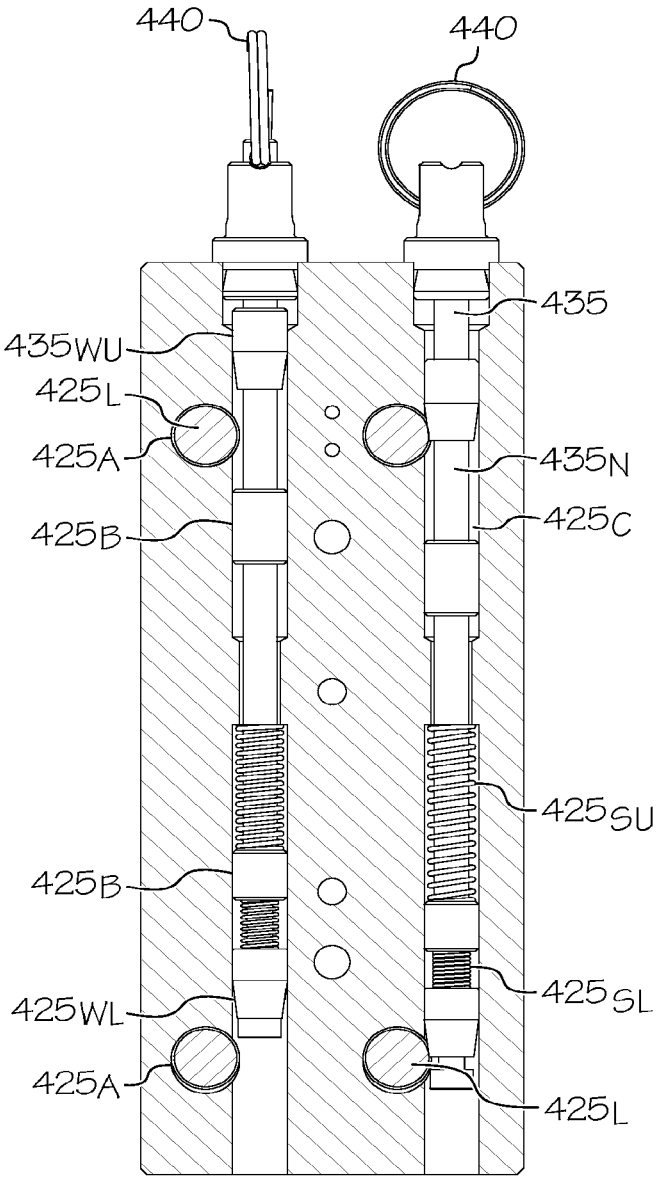
FIGS. 10A through 10D show details relating to the base structure retaining system according to an aspect of the present invention.
Figure 10C:
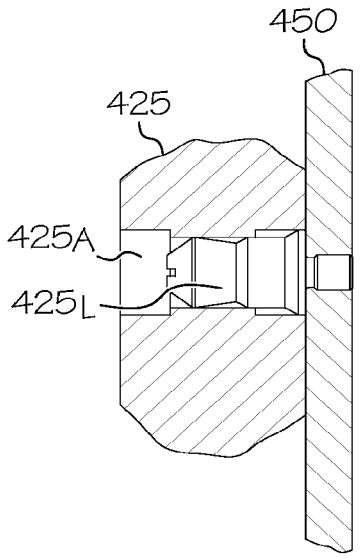
Figure 10D:
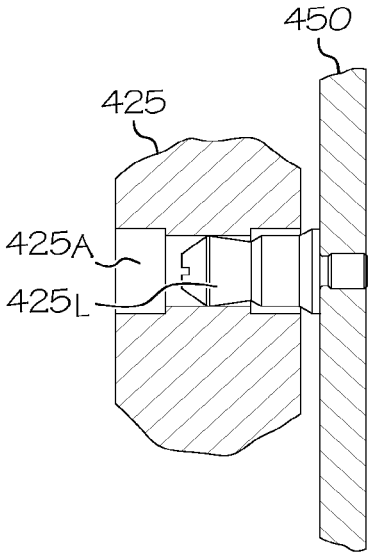
Figure 10B:
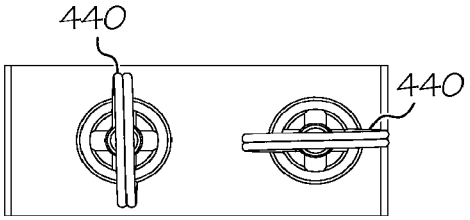

Cooperating pins 435 (also referred to herein as rods) may be placed within respective components (such as the base structure 425, mounting plate 450 or the like). The pin 435 defines a taper at its distal end; in this way it promotes interlocking with similarly stepped and tapered locating pins $\mathbf{425}_L$. By having double steps, the pin $\mathbf{425}_L$ can be both self-aligning (typically at the last moment before mounting between the base structure 425 and the respective valve assembly 410 or seal surface 430 as a way to make it easier to simultaneously fit the spaced-apart pins 435 onto the equally spaced-apart apertures $\mathbf{425}_A$ or related mounting locations within the base structure 425. This is deemed to be preferable to having the pins 435 all be the same diameter (which would be very difficult to align). The figure also shows that the pin 435 connected to the pull ring 440 disengages both lower and upper locking wedges $\mathbf{425}_{WL}$ and $\mathbf{425}_{WU}$. When the pin 435 is moved by pulling on the pull ring 440, the upper locking wedge $\mathbf{425}_{WU}$ disengages directly. Because the upper and lower locking wedges $\mathbf{425}_{WU}$, $\mathbf{425}_{WL}$ are connected via springs $\mathbf{425}su$ and $\mathbf{425}_{SL}$, The lower locking wedge $\mathbf{425}_{WL}$ also disengages after the lower spring $\mathbf{425}_{SL}$ force is overcome. The upper spring $\mathbf{425}_{SU}$ force provides resistance to keep the upper locking wedge $\mathbf{425}_{WU}$ in place. This enables the upper and lower locking wedges $\mathbf{425}_{WU}$, $\mathbf{425}_{WL}$ to unlock independently, allowing the part to be manufactured with reasonable tolerances and still operate reliably. The locking wedges $\mathbf{425}_{WU}$, $\mathbf{425}_{WL}$ engage on the surface of the locating pin $\mathbf{425}_L$. Bearings 425B around the pin 435 allow it to move up and down in a direction co-axial with the locking wedges $\mathbf{425}_{WU}$, $\mathbf{425}_{WL}$, preventing the pin 435 from sticking. Significantly, this double spring locking mechanism for pins 435 works such that pulling on one central pin 435 on the base structure 425 separately disengages wedges $\mathbf{425}_{WU}$, $\mathbf{425}_{WL}$ on the upper and lower locating pins $\mathbf{425}_L$. This promotes tool-less coupling by having the locating pins $\mathbf{425}_L$ that attach the various pieces to the base structure require only finger pulling on the ring 440 to disengage the wedges $\mathbf{425}_{WU}$, $\mathbf{425}_{WL}$ that hold the locating pins $\mathbf{425}_L$. Moreover, the spring-loaded release will hold the pins 435 in each of the released and fixed position. In this way, the circular pull ring 440 will retain itself with two perpendicular retaining grooves so that the user doesn't have to keep force on the pin 435 while removing the reversible parts. As such, it can be held in its unlocked position during the reversing process and then put back to the locked position by pulling and twisting the ring 440. FIGS. 10C and 10D show side elevation partial cutaway views to emphasize the engagement between orifice $\mathbf{425}_A$, the pin 435 and locating pin $\mathbf{425}_L$, the mounting plate 450 and the base structure 425. As discussed previously, although the spring-loaded pins 435, pull rings 440 and related components used to permit the selective tool-free release of one or more of the valve assembly 410, guides 420 and sealing surface 430 from the base structure 425 is shown being used in exemplary fashion on the embodiment depicted in FIGS. 4A and 4B, it may also be used in conjunction with the other embodiments depicted herein, and as such are also deemed to be within the scope of the present invention.

Figure 11:
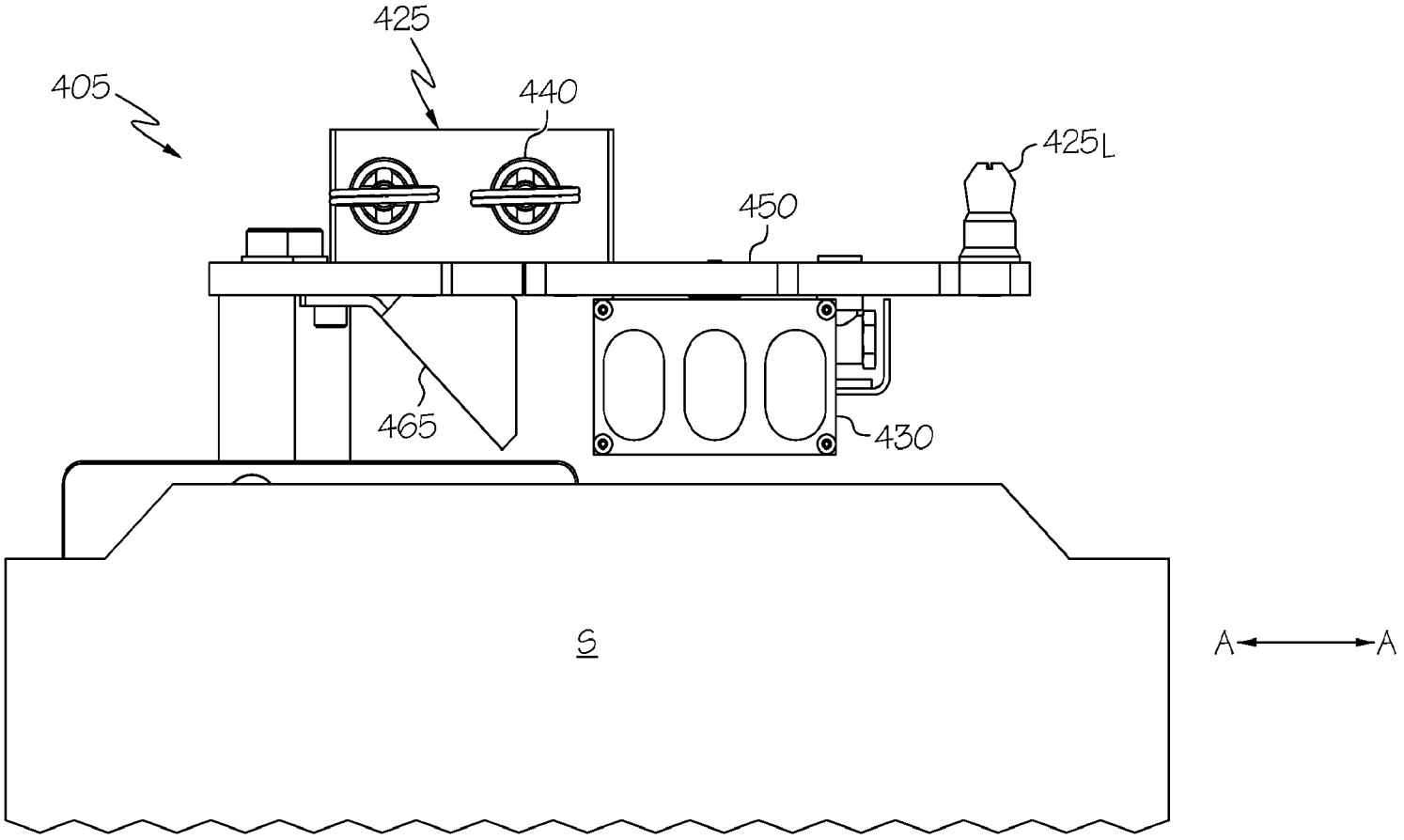
FIG. 11 shows details relating to the deflector plate according to an aspect of the present invention.

Referring next to FIG. 11 in conjunction with FIGS. 4A and 4B, one or more sheet deflector shields 465 can be attached to various locations on the base structure 425, mounting plate or other structure as needed to protect the sealing surface 430 from sheets S that pass through the non-contact adhesive applicator 405. If the product (for example, a corrugated sheet S) were to move toward the modular mounting plate for the dispenser 405, the sheet S would hit the deflector shield 465 first such that it is coaxed back into its proper travel path along the sheet-feeding axis A-A that is formed adjacent two or between the one or more guiding surfaces. In this way, any sheet S stray movement is corrected before it can contact (and possibly damage) the sealing surface 430 or the dispensing valves 415. As discussed above, although the deflector shields are described as being used in exemplary fashion with the embodiment depicted in FIGS. 4A and 4B, it may also be used in conjunction with the other embodiments depicted herein, and as such are also deemed to be within the scope of the present invention.

Figure 12A:
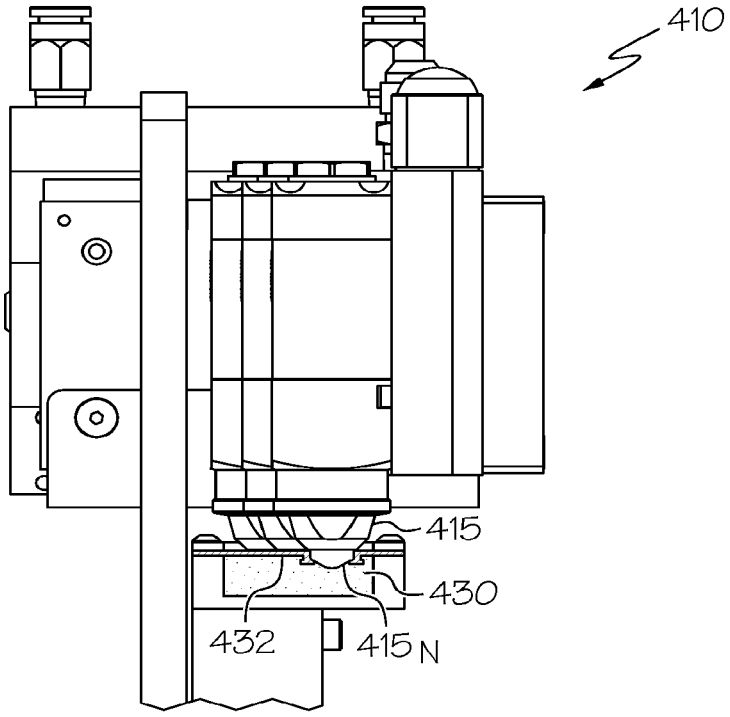
FIGS. 12A and 12B show how a sealed chamber of liquid or gel would be used to seal the nozzles according to one sealing embodiment of the present invention.
Figure 12B:
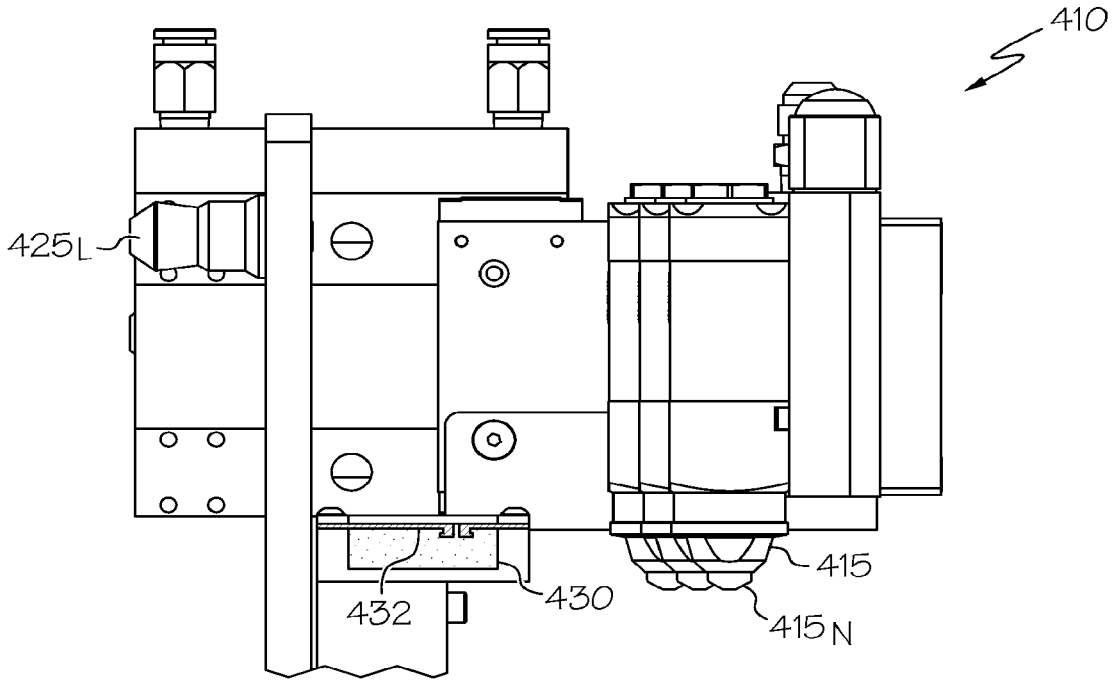
Figure 13A:
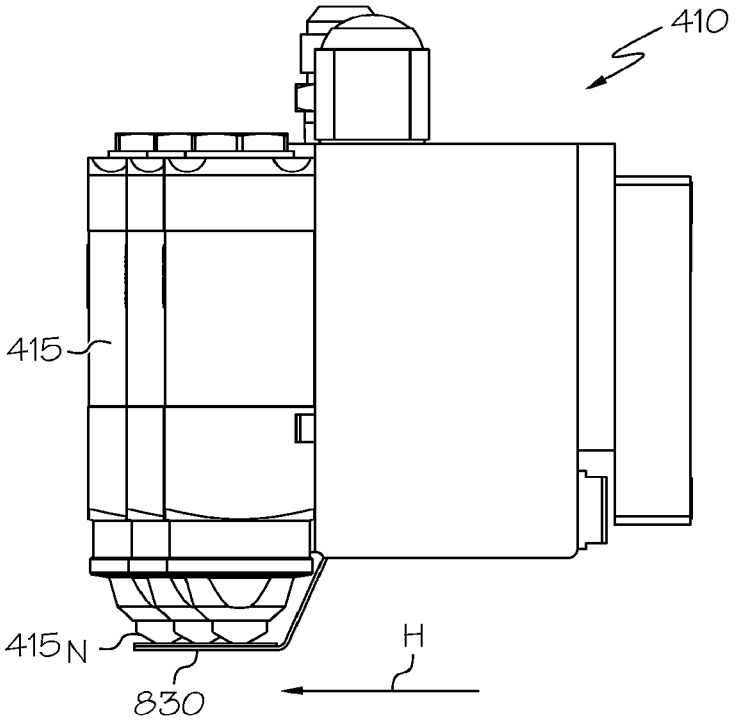
FIGS. 13A through 13D show elevation (FIGS. 13A and 13B) and plan (FIGS. 13C and 13D) views of how a sealing surface would slide back and forth across the nozzle tips to seal them and open them for dispensing according to another sealing embodiment of the present invention.
Figure 13B:
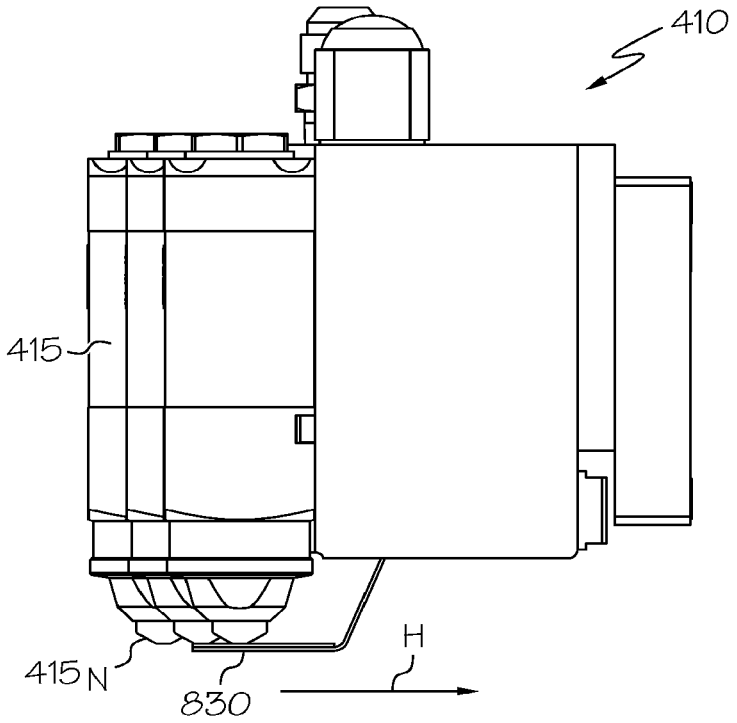
Figure 13C:
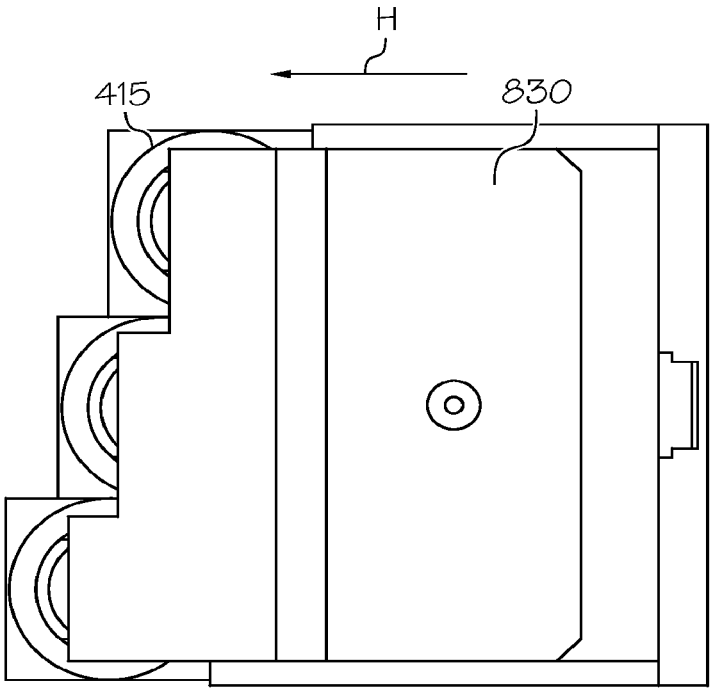
Figure 13D:
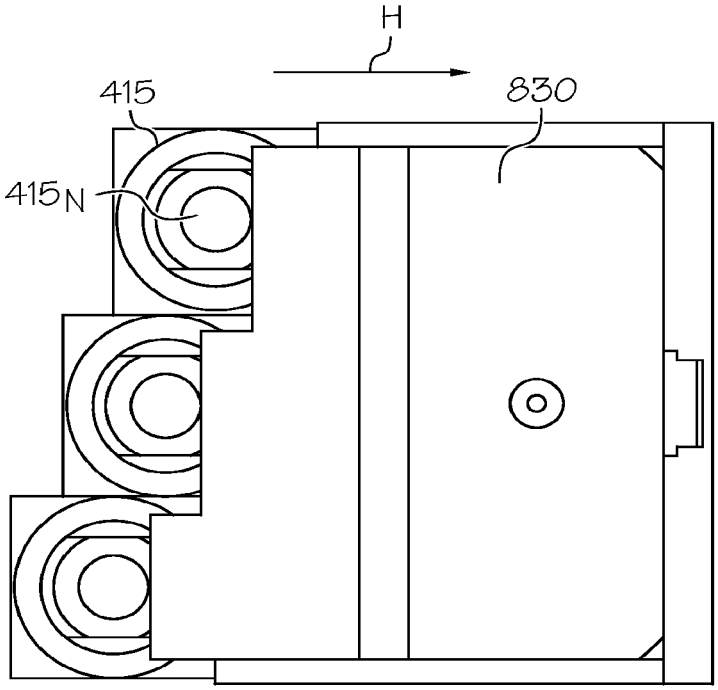

Referring next to FIGS. 12A and 12B in conjunction with FIGS. 4A and 4B, details of a liquid or gel bath are shown. The bath is shown first (FIG. 12A) with the nozzles $\mathbf{415}_N$ engaged with the sealing surface. Because the nozzles $\mathbf{415}_N$ are fully surrounded by the liquid or gel in the bath, the adhesive in the nozzle $\mathbf{415}_N$ will be prevented from drying out on the tip. As mentioned above, the process of the nozzle $\mathbf{415}_N$ pushing into the sealed bath will also clean debris from the nozzle $\mathbf{415}_N$ tips. As shown with particularity in FIG. 12B, the nozzles $\mathbf{415}_N$ are also shown out of the bath in a position ready for dispensing. As can be seen in this view, the seal surface 430 may include a flexible flap-like closure 432 that is configured to be substantially closed when no nozzles $\mathbf{415}_N$ are present, but capable of being easily pushed aside by the nozzle $\mathbf{415}_N$ tips as needed. In this way, when the nozzles $\mathbf{415}_N$ are not engaged with the seal surface 430, the flap-like closure substantially isolates the liquid or gel within the seal surface 430 from the ambient air.

Referring next to FIGS. 13A through 13D in conjunction with FIGS. 4A and 4B, an embodiment of a sealing surface is shown in which a sealing plate 830 slides across the nozzles $\mathbf{415}_N$ to seal them. In one form, the plate 830 may be compliant in order to exert spring force against the nozzles $\mathbf{415}_N$ to promote the sealing. The seal could be a single plate with a staggered design (as shown with particularity at the bottom of FIGS. 13A and 13B in the engaged and disengaged position, along with the respective positions in the plan views of FIGS. 13C and 13D) to match the staggered position of the nozzles $\mathbf{415}_N$, or could be comprised of individual plates (not shown) for each nozzle $\mathbf{415}_N$. The plates 830 are coupled to an actuator that is either part of the modular valve assembly 410, part of the base structure 425 or part of each valve 415 individually. The plate or plates 830 would slide in a direction H (as shown by the arrows) that is within the same general plane as the sheet-feeding axis yet orthogonal to the sheet-feeding axis A-A. As such, both sheet-feeding and sealing plate 830 movement would take place in a plane that is orthogonal to the flow direction of the adhesive stream.

Referring next to FIG. 14, unlike the sliding and translating seal surfaces 430, 530, 630, 730 and 830 discussed above, a rotating sealing surface 930 may be made to rotate or pivot about a generally horizontal axis to place the sealing surface 930 selectively into or out of contact with the nozzles $\mathbf{415}_N$, depending on the dispenser 405 mode of operation. As with the plate-like or bath-like embodiments of the sealing surfaces discussed above, the sealing surface 930 could be a single surface affixed to the modular valve assembly 410, or individual for each nozzle 415. Moreover, its pivoting action—as with the previous embodiments—could be controlled by an actuator that would be part of each valve 415, the modular valve assembly 410 or coupled to or part of the base structure 425.

By way of recap using the embodiment of FIGS. 4A and 4B as a non-limiting example, in one form, the liquid dispenser 405 may include one or more applicator valves 415 with nozzles $\mathbf{415}_N$, and a sealing surface 430 movable to seal the nozzles $\mathbf{415}_N$. The applicator valves 415 and sealing surface 430 may be reversibly coupled to a base structure 425. One or more guiding surfaces 420 are coupled to or formed as a part of base structure 425 for defining product travel path (i.e., sheet-feeding axis) A-A. In another form, the liquid dispenser 405 has one or more applicator valves 415 with nozzles $\mathbf{415}_N$ reversibly coupled to base structure 425. One or more guiding surfaces 420 may also be included, and are used to define a product (for example, sheet S) travel path as the product passes adjacent the nozzles $\mathbf{415}_N$ of the applicator valves 415. In one version, the guiding surface 420 may form a single-sided sheet-feeding travel path that comes into contact with one side of the sheet S, while in another, it can be formed as a double-sided travel path through a pair of parallel-spaced surfaces that allow the passage of the sheet S through the space defined between them. In either the single-sided or double-sided configuration, the guiding surface 420 (as well as the sealing surface 430, either in conjunction with the guiding surface 420 or separately from it) may be rigidly mounted to the base structure 425 or the valve assembly 410, removably coupled, or removably and reversibly mounted to accommodate various sheet-feeding and liquid-dispensing configurations.

It will be appreciated by those skilled in the art that while the subsequent discussion is with regard to the dispenser operating on glue and related adhesives, the structure is not so limited, as such structure is equally applicable to the deposition of other liquids (for example, soap, lotion, release varnish or the like) onto a generally planar substrate. Likewise, while certain representative embodiments and details have been shown for purposes of illustrating the invention, it will be apparent to those skilled in the art that various changes may be made without departing from the scope of the invention, which is defined in the appended claims.

What is claimed is:

1. A method of depositing an adhesive on a sheet of material, the method comprising:

configuring an adhesive dispenser to comprise:

a base structure comprising:

at least one removably and reorientably secured guiding surface that defines a travel path for the sheet of material; and a removably and reorientably secured sealing surface; and a valve assembly reversibly coupled to the base structure and defining at least one adhesive-dispensing nozzle for the selective passage of adhesive therethrough, the sealing surface configured to be movable relative to the at least one adhesive-dispensing nozzle;

upon operation of the adhesive dispenser in conjunction with a gluing station that acts as a source of the adhesive, and further upon receipt of the sheet of material into the travel path, the valve assembly places the adhesive onto the sheet through the at least one adhesive-dispensing nozzle; and upon closure of the at least one adhesive-dispensing nozzle during periods of inoperability of the gluing station, the sealing surface moves into engagement with the at least one adhesive-dispensing nozzle such that residual portions of the adhesive within the adhesive-dispensing nozzle become substantially isolated from an ambient atmospheric environment.

2. The method of claim 1, wherein the at least one adhesive-dispensing nozzle comprises a plurality of adhesive-dispensing nozzles.

3. The method of claim 2, wherein the plurality of nozzles are arranged in a staggered pattern along the travel path such that placed individual beads of the adhesive onto the sheet do not overlap one another for at least a majority of the travel path.

4. The method of claim 1, wherein the sealing surface comprises a liquid bath.

5. The method of claim 1, wherein the sealing surface comprises a pad made of elastomeric material.

6. The method of claim 1, wherein the reversible coupling of the valve assembly and the sealing surface to the base structure is through at least one attachment that permits at least one of them to be interchangeably disposed above or below the travel path.

7. The method of claim 6, wherein the attachment comprises at least one pin with a corresponding spring-based tool-free connection.

8. The method of claim 7, wherein the at least one spring-based tool-free connection comprises a locking mechanism formed between at least the base structure and at least one of the valve assembly and the sealing surface.

9. The method of claim 8, wherein the pin defines steps along its axial dimension to promote selective engagement with at least one locating pin.

10. The method of claim 9, wherein the pin is formed on the base structure and the at least one locating pin is formed on at least one of the valve assembly and the sealing surface.

11. The method of claim 10, wherein the adhesive dispenser is further configured to releasably couple at least one of the valve assembly and the sealing surface through a tool-free connection with the base structure.

12. The method of claim 11, wherein the tool-free connection comprises a pull ring formed at a substantial end of the pin to effect the selective engagement.

13. The method of claim 12, wherein the pull ring is rotatably mounted within the base structure to permit a user to remove at least one of the valve assembly and the sealing surface from the base structure without having to maintain a pulling force on the pin as a way to overcome an axial bias force formed therealong.

14. The method of claim 1, wherein the at least one removably and reorientably secured guiding surface comprises a pair of vertically-spaced guiding surfaces such that the travel path is defined thereby along a substantially horizontal orientation between them.

15. The method of claim 14, wherein at least one of the vertically-spaced guiding surfaces is reversibly coupled to the base structure.

16. The method of claim 1, wherein the sealing surface is pivotably coupled to at least one of the base structure and the valve assembly.

17. The method of claim 1, wherein the adhesive dispenser forms part of a flexo-folder gluer assembly.

* * * * *